US007726214B2

(12) United States Patent
Schoen

(10) Patent No.: US 7,726,214 B2
(45) Date of Patent: Jun. 1, 2010

(54) METHOD AND DEVICE FOR THE CONTACTLESS DETECTION OF FLAT OBJECTS

(75) Inventor: Dierk Schoen, Egelsbach (DE)

(73) Assignee: Pepperl + Fuchs GmbH, Mannheim (DE)

( * ) Notice: Subject to any disclaimer, the term of this patent is extended or adjusted under 35 U.S.C. 154(b) by 329 days.

(21) Appl. No.: 10/597,028

(22) PCT Filed: Dec. 22, 2004

(86) PCT No.: PCT/EP2004/014639

§ 371 (c)(1),
(2), (4) Date: Oct. 9, 2008

(87) PCT Pub. No.: WO2005/066050

PCT Pub. Date: Jul. 21, 2005

(65) Prior Publication Data

US 2009/0050826 A1 Feb. 26, 2009

(30) Foreign Application Priority Data

Jan. 7, 2004 (DE) ..... 10 2004 001 314
Nov. 24, 2004 (DE) ..... 10 2004 056 742

(51) Int. Cl.
*B65H 7/04* (2006.01)
*B65H 7/12* (2006.01)
*G01N 33/34* (2006.01)

(52) U.S. Cl. ..... 73/865.8; 271/258.01; 271/265.01

(58) Field of Classification Search ..... 73/865.8; 271/258.01, 259, 261, 262, 263, 264, 265.01, 271/265.02, 265.03, 264.04; 340/674; 367/93, 367/95; 702/170, 171, 172, 175
See application file for complete search history.

(56) References Cited

U.S. PATENT DOCUMENTS 4,015,464 A 4/1977 Miller et al.

(Continued)

FOREIGN PATENT DOCUMENTS

DE 3048710 C2 7/1982

(Continued)

OTHER PUBLICATIONS

PCT International Preliminary Examination Report on Patentability, International Application No. PCT/EP2004/014639, International Filing Date Dec. 22, 2004.

(Continued)

*Primary Examiner*—David A. Rogers
(74) *Attorney, Agent, or Firm*—John A. Merecki; Hoffman Warnick LLC

(57) ABSTRACT

A method and device for the contactless detection of flat objects, particularly in sheet form, such as paper, films, foils, plates, labels, splices, break points, tear-off threads and similar flat materials or packs. A sensor device, such as a receiver-following evaluating device, is supplied with at least one correction characteristic, by means of which a measuring signal input voltage characteristic in the receiver is simulated as a function of the gram weight or weight per unit area of the flat objects as a target characteristic in such a way that there is obtained a linear or almost linear dependence or a characteristic approximated to the ideal single sheet detection characteristic in the form of a target characteristic.

72 Claims, 15 Drawing Sheets

U.S. PATENT DOCUMENTS

Figure 1:
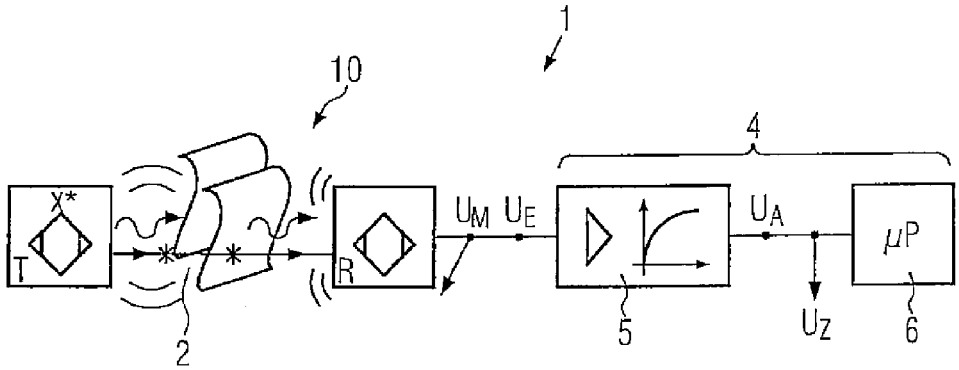

| | | | |
|---|---|---|---|
| 4,173,898 | A | 11/1979 | Forstermann et al. |
| 4,366,712 | A | 1/1983 | Bathmann et al. |
| 5,222,729 | A | 6/1993 | Wallaschkowski |
| 6,212,130 | B1 | 4/2001 | Brazeal, Jr. et al. |
| 6,511,064 | B1 | 1/2003 | Phinney et al. |
| 2001/0042956 | A1 | 11/2001 | Minoru et al. |
| 2003/0006550 | A1 | 1/2003 | Chujo et al. |

FOREIGN PATENT DOCUMENTS

| | | | |
|---|---|---|---|
| DE | 3236017 | C2 | 3/1984 |
| DE | 3620042 | A1 | 1/1987 |
| DE | 4022325 | C2 | 1/1992 |
| DE | 4403011 | C1 | 2/1995 |
| DE | 19521129 | C1 | 10/1996 |
| DE | 29722715 | U1 | 4/1999 |
| DE | 19921217 | B4 | 11/2000 |
| DE | 19927865 | B4 | 1/2001 |
| DE | 20312388 | U1 | 11/2003 |
| DE | 4233855 | C2 | 7/2006 |
| EP | 0997747 | B1 | 5/2000 |
| EP | 1201582 | A3 | 5/2002 |
| EP | 1067053 | B1 | 1/2004 |

OTHER PUBLICATIONS

U.S. Appl. No. 10/597,027, filed Apr. 4, 2007, USPTO Office Action *Ex parte Quayle*, Notification Date Nov. 25, 2008, pp. 1-14.

METHOD AND DEVICE FOR THE CONTACTLESS DETECTION OF FLAT OBJECTS

The invention relates to methods and devices for the contactless detection of flat objects.

Methods and devices of this type are used e.g. in the printing industry to establish in the case of paper, foils, films or similar flat materials in printing and production processes whether a single or multiple sheet or alternatively a missing sheet exists. In the printing process it is normally necessary to have a single sheet and if a multiple sheet, e.g. a double sheet is detected it is necessary to eliminate such a double sheet in order to protect the printing press. Analogously when it is found that instead of a single sheet a "missing sheet" is present, the normal printing press must be modified or interrupted until once again a single sheet is detected.

In a comparable manner such methods and devices are also used in the packaging industry, in which labels e.g. applied to the base or support material are counted or monitored for presence or absence. Another field of use is the detection of tear-off threads or break points, particularly in the case of thin foils used for enveloping purposes, such as e.g. cigarette packs. However, also metal-laminated papers, flat plastic sheets or foils and plates can be detected in contactless manner in production processes using such methods and devices.

The measuring principle used in such methods and devices when e.g. employing ultrasonics and detecting papers in flat sheet form is based on the fact that the ultrasonic wave emitted by the transmitter penetrates the paper and the transmitted fraction of the ultrasonic wave is received as a measuring signal by the receiver and evaluated with respect to its amplitude. If a multiple or double sheet is present, a much smaller amplitude is set in the receiver than when a single sheet is present.

The following evaluation of the measuring signal received has consequently hitherto taken place with approximately linearly operating amplifiers or similarly designed amplifying circuits and downstream filters. As a result of the relatively limited dynamic range present, particularly of linear amplifiers, it was often difficult or impossible to detect thick papers, cardboard box materials or even corrugated boards. In addition the fluttering behaviour which often occurs more particularly with very thin papers or foils and which is in fact a movement of a thin, flexible sheet during detection between transmitter and receiver in the direction of the sheet normal line, could only be inadequately controlled using such amplifiers. A comparable behaviour is exhibited by highly inhomogeneous materials.

With a view to a better control of the aforementioned problems, specifically in the case of widely differing material-specific attenuation of the transmitted signal and in connection with which hereinafter reference will be made solely to weights per unit area and gram weights, a learning step was performed. Before the start of the actual detection process the flat object to be detected, such as e.g. a paper sheet, is detected in connection with its gram weight or its sound absorption characteristics and inputted into the evaluating device in the sense of a learning step.

A significant disadvantage is that in the case of other flat objects with a different gram weight it is once again necessary to perform a corresponding learning step, which is on the one hand complicated and on the other normally leads to considerable disuse periods for the corresponding plants.

In connection with the material specifications for papers reference is made to the relevant standards, e.g. DIN pocketbook 118 (2003-06 edition), DIN pocketbook 213 (2002-12 edition), DIN pocketbook 274 (2003-06 edition), DIN pocketbook 275 (1996-08 edition) or to DIN 55468-1 relative to corrugated board.

DE 200 18 193 U1/EP 1 201 582 A (2) discloses a device for the detection of single or multiple sheets. For detecting such sheets the known device has at least one capacitive sensor and at least one ultrasonic sensor. An evaluating unit is provided for deriving a signal for detecting the single or multiple sheet. Said signal is derived from a logical interconnection of the output signals of the sensors, the detection signal being established in a balancing phase.

Another device in the form of a capacitive sensor is known from DE 195 21 129 C1. This device primarily directed at the contactless detection of labels on a base material works with two capacitor elements and an oscillator influencing the same. The dielectric characteristics of the paper or of other flat objects consequently influence the resonant circuit of the oscillator with regards to the frequency, which is evaluated for detection purposes.

However, it is disadvantageous that it is difficult or even impossible to detect relatively thin papers, as well as metal-laminated papers. Due to their limited thickness and in part the fact that their dielectric constant only differs slightly from one, very thin foils are also difficult to detect.

Further detection methods using ultrasonic proximity switches are e.g. described in EP 997 747 A2/EP 981 202 B1. In the case of these keying sensors there is an automatic frequency adjustment in which following the emission of an ultrasonic pulse and subsequent reflection on the object to be detected, the optimum transmitting frequency is evaluated as a function of the level of the ultrasonic echo amplitude received.

Another device of the aforementioned type is known from DE 203 12 388 U1 (1). This ultrasonically operating device establishes the presence and thickness of the corresponding objects via the transmission and reflection of radiation. However, this device also uses reference reflectors, so that the device has a relatively complicated construction.

DE 297 22 715 U1 discloses an inductively operating device for measuring the thickness of plates, which can be made from ferrous or nonferrous metals. The measurement of the plate thickness takes place through the evaluation of the operating frequency of a frequency generator or through evaluating its amplitude. For setting this device it is firstly necessary to perform a learning step, in which a calibration plate is introduced into the measurement zone and the operating frequency or amplitude of the frequency generator is set in accordance with a standard thickness curve.

Admittedly such a device makes it possible to distinguish between single, missing and multiple plates, but for this purpose different standard thickness curves must be stored and evaluated for making the decision in question. In addition, this device is suitable for detecting plate thicknesses up to approximately 6 mm. Due to the limited attenuation change the detection of thin plates or foils is not very reliable.

DE 44 03 011 C1 describes a device for separating nonmagnetic plates. For this purpose a travelling field inductor exerts a force opposing the plate set conveying direction when a double plate is present, so that the said double plate is separated into two plates. This device is completely unsuitable for nonmetallic, flat objects or foils.

DE 42 33 855 C2 describes a method for the control and detection of inhomogeneities in sheets. This method operates optically and is based on a transmission measurement. However, particularly when controlling paper sheets with respect to the presence of single and multiple sheets, the problem arises that as a result of the material characteristics of the sheets there can be very considerable fluctuations as a result of inhomogeneities or the reflection behaviour and fluttering of the sheets. To overcome this problem this document provides a measuring value evaluation using fuzzy logic rules.

US 2003/0006550 discloses a method performing a digital evaluation based on ultrasonic waves and the phase difference between a reference phase and the phase received and on this basis a signal is determined for the detection of missing, single or multiple sheets. However, solely evaluating the phase difference can be inadequate in the case of special papers or foils and lead to incorrect information, which is to be avoided for bringing about a reliable detection.

DE 30 48 710 C2 discloses a method more particularly usable for counting banknotes, but also for other papers and foils. This method based on determining the weight per unit area or thickness of the materials to be detected, operates with pulse-shaped ultrasonic waves and for detecting a double sheet, i.e. the presence of two mutually covering or overlapping banknotes, use is more particularly made of the evaluation of the integration of the phase shift. Thus, the main use of this method is the counting of banknotes or comparable papers and foils, whilst taking account of the weights per unit area of such materials. Therefore this method would appear to be unsuitable for use with packaging materials or for counting labels.

DE 40 22 325 C2 discloses another acoustically or ultrasonically based method. This method, which is based on controlling missing or multiple sheets in the case of sheet or foil-like objects, requires a first pass of the corresponding flat object with a calibration and setting process, which is automatically performed in microprocessor-controlled manner. Thus, with this method a learning step is initially required concerning the thickness of the object relative to an optimum measuring and frequency range and during such a first pass a corresponding threshold value must be detected and stored.

Comparable methods and devices are known in connection with the detection or counting of labels. Firstly the difference relative to a label must be considered, because it is provided as an applied material coating to a base or support material. This laminated material behaves to the outside with regards to opacity, dielectric, electromagnetic conductivity or sound travel time in the manner of a composite material piece, so that there is a comparatively limited, but still evaluatable attenuation in the case of such detection possibilities.

DE 199 21 217 A1 (7), together with DE 199 27 865 A1 and EP 1 067 053 B1 discloses a device for detecting labels or flat objects. This device uses ultrasonic waves with a modulation frequency and for distinguishing single and multiple sheets a threshold value is determined during a balancing process or a learning step. By means of the learning step it is possible to adjust the detection to a specific flat object in the sense of a label. However, this learning step makes the device more complex and requires longer setting times when changing to a different flat object. This shows that a broader material spectrum cannot be detected per se, but only matched to a specific, individual material.

Bearing in mind this prior art, the object of the invention is to design a method and a device for the contactless detection of flat objects, permitting in a very flexible manner over a wide material spectrum a reliable detection of single, missing or multiple sheets with different flat materials on the one hand, particularly papers, foils, films, plates, etc., and on the other in the case of labels and similar laminated materials, without requiring a learning step and using different beams or waves such as those of an optical, acoustic, inductive or similar nature.

A fundamental idea of the invention is to provide for the evaluation of the measuring signal over a gram weight and weight per unit area range a correction characteristic, so that over the material range provided it is possible to achieve a target characteristic with a substantially or virtually linear course or for papers and similar materials a characteristic approaching the ideal characteristic for single sheet detection and permitting in the case of an amplitude evaluation of the amplified measuring signal a clear distinction, particularly compared with a corresponding threshold value for air, as a threshold for a missing sheet, or compared with a threshold value for double sheets.

To achieve this, it is a further essential idea of the invention that in the case of a signal amplification of the measuring signal received, the correction characteristic of the corresponding signal amplification is given statically or dynamically in order to obtain a readily evaluatable target characteristic.

However, the invention also takes account of the fact that a direct conversion of the measuring signal can be performed within the framework of an A/D conversion and the digital values of the measuring signal characteristic obtained are subject to the corresponding, purely digital correction characteristic, so as to directly obtain the evaluatable target characteristic.

This principle of using a correction characteristic also has the major advantage that it is possible to use different sensor devices, particularly as a barrier or barrier arrangement, e.g. with a forked shape and advantageously use is made of ultrasonics, optical, capacitive or inductive sensors and the same method can be used for each of them.

The corresponding correction characteristic for papers and similar materials is more particularly obtained by mirroring the measuring value characteristic on the ideal target characteristic for single sheet detection, optionally using a special transformation of the Cartesian coordinate system.

The correction characteristic can also be chosen inversely or virtually inversely to the characteristic of the input voltage $U_E$ of the measuring signal. It is possible in this way and in a good approximation to obtain an ideal target characteristic for single sheet detection over a relatively wide gram weight or weight per unit area range of the objects to be detected, particularly between 8 and 4000 g/m$^2$. Inverse is considered to be an inverse function.

Thus, the inventive method is not only suitable for detecting single, multiple or missing sheets of thin to thick papers, which are in the aforementioned gram weight range. It is also possible to detect stackable, box-like packs of paper or plastic or labels applied to base material, or splice, tear-off or break points of paper or foils.

If, from the method standpoint, the measuring signal obtained at the output of the receiver or measuring signal converter is subject to a signal amplification for further evaluation purposes, preferably the corresponding amplifier device impresses the corresponding correction characteristic, which can also comprise a combination of several correction lines, so as at the output side to obtain for further evaluation purposes a readily evaluatable target characteristic over the entire weight per unit area range. Using this target characteristic it is possible in a downstream method step which can e.g. be implemented in a microprocessor, to detect the corresponding flat object with regards to specific threshold values, so as to obtain a clear detection signal regarding single, missing or multiple sheets.

As an alternative the method also provides that the measuring signal or its measuring signal characteristic obtained in the receiver is directly subject to an analog-digital conversion and, taking account of a corresponding purely digital correction characteristic, said digital values are processed to a target characteristic for producing a corresponding detection signal.

According to the invention these measures lead to the advantage that a reliable detection is obtained of the corresponding flat objects over a very wide gram weight and weight per unit area range without the need for a learning process, which would lead to plant disuse times. In addition, the dynamic range of the evaluating device is significantly extended, so that it is reliably possible to detect very thin or very inhomogeneous materials having a fluttering tendency. Therefore the method according to the invention makes it possible on the basis of the amplitude evaluation of the measuring signal received in the receiver and by using a correction characteristic and target characteristic to make a reliable distinction between single, missing and multiple/double sheets and this applies also for very thin or very sound-transmissive objects, e.g. with a weight per unit area from 8 g/m2 or a thickness of approximately 10 μm to relatively thick and highly sound-transmissive objects up to 4000 g/m2 and e.g. a thickness of 4 mm, without any prior learning process being required to enable a reliable distinction to be made.

In connection with high flexibility, not only relative to the most varied papers such as corrugated board or plastic packs, the invention also provides the taking into account of correction characteristics, which represent a combination of different correction characteristics, said combined correction characteristics also being applicable solely in a zonal manner over parts of the overall gram weight range. As a result the target characteristics can have an improved approximation to the ideal characteristic for detecting single sheets.

Corresponding to the circumstances of the circuitry design of the evaluating device, the sensor device used and/or the sought material spectrum, the correction characteristic can also be designed zonally as a linear or nonlinear characteristic, as a single or multiple logarithmic characteristic, as an exponential characteristic, as a hyperbolic characteristic, as a polygonal line, as a random degree function or empirically determined or calculated characteristic or as a combination of several of these characteristics.

With a view to the combined detection of labels and single, missing and multiple sheets, preferably the correction characteristic is designed as an approximately linearly rising and weighted or exponentially or similarly rising characteristic or as a logarithmic, multiple logarithmic or similar nonlinear characteristic, also in combination with the first-mentioned correction characteristics.

Thus, according to the invention, both in a method and by means of a device it is possible to detect labels, splice, tear-off or break points and similarly built up materials without a learning step. It must be borne in mind that the weight per unit area range for labels and similar materials can be from approximately 40 to approximately 300 g/m2, i.e. is relatively narrow.

It is also to be borne in mind that with labels, in certain circumstances with only minor gram weight differences between the base or support material and the adhesively applied, multilaminated materials, such as e.g. labels, there is a relatively small difference in the attenuation, e.g. of ultrasonic waves, so that the aim is to obtain in the target characteristic a maximum voltage swing of target characteristic ZK in the case of a small voltage swing of the measuring value characteristic MK.

The correction characteristic for detecting labels is therefore preferably at least linear and said linear correction characteristic KK has a weighting function, or is chosen in exponentially rising manner.

As a substantially ideal target characteristic for labels and similar materials in optimum manner the function of the output voltage $U_A$ or $U_Z$ as a function of the gram weight g/m$^2$ is sought in the form of a curve or straight line, namely with a maximum, constant negative gradient ($\Delta U_Z$=maximum and constant) and therefore maximum voltage difference. Therefore there is a maximum voltage swing ($\Delta U_Z$=max.) with respect to the base or support material and the adhesively applied, multilaminated materials, such as e.g. labels, even in the case of minor gram weight variations as a function of the total gram weight or weight per unit area range.

Therefore such an ideal target characteristic for the detection of labels, even in the case of small to very small gram weight differences makes it possible to generate a clearly defined detection signal for detecting labels and similar materials. In the case of labels and similar materials evaluation primarily takes place regarding the presence or absence or a multiple layer reduced by at least one layer.

The invention also makes it possible to implement such a combination of correction lines, e.g. also in separate paths or channels. The logarithmic and/or double logarithmic correction line can e.g. be impressed in the first channel, so as to consequently primarily permit reliable double sheet detection. The second channel can e.g. be subject to an exponentially or linearly rising correction characteristic, so as to be able to implement in optimum manner in said path the detection of labels, splices or threads.

This combination of the two methods with logarithmic correction characteristic combined with exponentially rising correction characteristic, consequently permits an optimum detection possibility for labels and similar materials, such as tear-off or break points and/or tear-off threads and single, missing and multiple sheets.

Thus, for label detection the aim is to permit a maximum constant signal swing over the entire material range in the case of the aforementioned design of the correction characteristic as a result of the target characteristic, i.e. ΔUZ should be at a maximum/constant.

As opposed to this, the correction characteristic method for detecting single, missing and multiple sheets is based on a design of the target characteristic in which, over the entire gram weight range, for single sheet detection purposes there is a minimum change to the amplitude values, i.e. ΔUZ=0 and ideally there is a constant magnitude or target characteristic with a gradient of approximately 0.

For practical purposes importance is attached to the combination of a logarithmic and a linear correction characteristic. The advantage of a signal amplifier with impressed logarithmic correction characteristic or a similar correction characteristic is more particularly that the signal amplifier has a very large dynamic range, so that a large ratio of voltage signals from the largest to the smallest signal can undergo processing. A linear signal amplifier can e.g. obtain a voltage-signal ratio of approximately 50:1, which corresponds to approximately 34 dB. However, a logarithmic signal amplifier achieves a voltage-signal ratio of $3\times10^4$:1, which is approximately 90 dB. When using a logarithmic signal amplifier, which is here understood to mean an impressed logarithmic correction characteristic, it is possible to counteract a signal overload at high signal amplitudes. This feature is advantageously used according to the invention in order to implement single, missing or multiple sheet detection and for the detection of stackable packs, without carrying out a learning process and over a very wide material spectrum.

Advantageously in the case of the method and the corresponding device according to the invention it is possible to use logarithmic and/or multiple logarithmic signal amplifiers, so that the possible material spectrum is extended to thin or very lightweight sheets. This is due to the fact that with an increasing signal level with said signal amplifiers the characteristic of the signal amplification passes into saturation and consequently there is virtually no signal swing. With falling signal amplification and large signals there are still readily evaluatable signals even with the most minor modifications, such as e.g. very thin paper sheets between transmitter and receiver.

When using nonlinear, particularly logarithmic and/or multiple logarithmic signal amplifiers, a further advantage is that the detectable material spectrum is extended to thicker or heavier sheets. This is due to the fact that with a low signal level amplification is very high and even the weakest signals still able to pass through a heavy or thick single sheet can be adequately amplified and evaluated. This characteristic is more particularly used for the detection of stacked packs or single, missing or multiple sheets.

According to another appropriate development of the invention, the correction characteristic is in particular empirically determined or calculated as a synthesized function. For this purpose it is e.g. possible to plot the transmission attenuation or the measuring signal voltage resulting therefrom as a function of the gram weight or weight per unit area of the object or objects to be detected and in this way determine the characteristics of the measuring signal of a plurality of different objects and from this the optimum inverse or virtually inverse correction line can be obtained mathematically or empirically in order to achieve a target characteristic at least approaching the ideal target characteristic for the detection of single sheets.

From the method standpoint it is also possible to impress in fixed manner or actively control or regulate the correction characteristic, so that an even better approximation to the ideal target characteristic is possible for the materials to be investigated.

For said control or regulation it is possible to use in the evaluating device, e.g. a microprocessor, a corresponding electrical network for adjusting the correction characteristic, a use-specific module or a resistance network.

According to a further development of the invention the target characteristic for different material spectra is subdivided into several sections, particularly three or five sections. In the case of three sections, it is e.g. possible to form a partial target characteristic for the gram weight range above 1200 $g/m^2$ for very thick papers and another section below 20 $g/m^2$ for a very thin paper spectrum. The introduction of target characteristic sections consequently permits an improved reliability with regards to single, missing or multiple sheet detection.

It is appropriate for labels, splice and break points or tear-off threads to provide at least one detection threshold and on dropping below the latter it is evaluated as a "multiple layer" and on exceeding it as a "base material" or as a "multiple layer" reduced by at least one layer.

With a view to a clear detection of single, missing or multiple sheets, particularly double sheets, the amplitude value is compared by means of the target characteristic with threshold values. These are in particular an upper threshold value for air and a lower threshold value for double or multiple sheets. Thus, if the incoming measuring signal with the corresponding target characteristic value is greater than the upper threshold value, it is evaluated as a "missing sheet". An incoming measuring signal smaller than the lower threshold value indicates a "multiple/double sheet". In the case of an incoming measuring signal with the corresponding value on the target characteristic between the threshold values, this is detected as a "single sheet".

In order to improve the detection possibilities, particularly with a view to a more precise setting to the material spectrum to be determined, the threshold values, particularly for multiple sheets, can be designed continuously or zonally defined in fixed manner or dynamically carried along. In this sense a dynamic double sheet threshold can be used for an additional extension of the measurable gram weights. For this purpose e.g. the single sheet value is measured and evaluated with the associated multiple sheet value, e.g. as a polygon function, when it is a single function, such as e.g. a falling line or a constant value for the single sheet.

The method and device can be more particularly implemented by means of at least one ultrasonic sensor device. For this purpose the sensor device preferably has at least one ultrasonic converter pair which are matched to one another and coaxially aligned. However, the method and device can also be implemented according to the invention with optical, capacitive or inductive sensors.

Using ultrasonic sensors it has been found that easy detection is also possible of flat objects with printing, colour printing or reflecting surfaces. It is also possible for the sensor pair, particularly in barriers and when assembled in forked form, to be fitted vertically or inclined to the sheet plane.

Appropriately the operating mode of the sensor device can be selected or switched as a function of the material spectra to be detected and the operating conditions either in pulsed or continuous operation form. For continuous operation preference is given to an inclined assembly of the sensor pair, so as in this way to avoid interference and standing waves. Appropriately continuous operation is so-to-speak designed as a quasi-continuous operation in that e.g. periodically the signal is switched off and on again in short time intervals compared with the evaluating time. To avoid standing waves it is also possible to have phase jumps in the transmitting signal.

Inclined assembly of the sensor element pair is particularly suitable for detecting thicker materials, e.g. single-corrugation or multiple-corrugation, particularly two-corrugation corrugated board, so as in this way to achieve a better material penetration and avoid interference.

It has also proved advantageous to modulate the transmitting signal with at least one modulation frequency. This makes it possible to correct or compensate converter tolerances, particularly in ultrasonic sensors. Although the sensor elements are matched to one another, they generally have different resonant frequencies. If for frequency modulation purposes use is made of a frequency sweep $f_s$ with a frequency much lower than the frequency to be excited, the resonance maximum of the sensor elements is periodically exceeded. If the response time of the sensor is well below $1/f_s$, in this way the converter characteristics of each individual sensor element or pair can be used in optimum manner for ultrasonic transmission. The frequency sweep is normally up to a few 10 kHz.

The tolerances of the sensor elements are appropriately automatically corrected before or during the continuous operation. This takes place by standardizing the sensor element pairs to a fixed value with a predetermined, fixed spacing, particularly the optimum assembly spacing. As a result poor sensor elements can be made better and good sensor elements or converters made poorer. To compensate this a correction factor is needed. From the method standpoint this can take place through the use of straight lines filed or calculated as value pairs in microprocessor μP, because the measuring signal is already rated with e.g. a single logarithmic correction characteristic and the correction characteristic produces an approximately linearly falling target characteristic over the converter or sensor element spacing. Thus, the input signal at the microprocessor of an evaluating device in good approximation drops linearly with the converter spacing. Thus, correction of the values is easy even with a variable spacing, because on switching on a corresponding device only a straight line function has to be calculated for the correct initial value or filed as a value pair. The correct determination of the sensor head spacing is carried out by a transit time measurement.

A particular advantage of the ultrasonic method is that the spacing between transmitter and receiver in the sensor device can be made variable for this learning-free method. In other words the sensor device can be relatively rapidly adapted spacingwise to different applications, without this impairing the measurement precision of the method. A further improvement to the method can be brought about by monitoring the spacing between the transmitter and receiver and the determination thereof. This determination of the spacing between transmitter and receiver can on the one hand take place by reflection of radiation between transmitter and receiver and on the other by reflection between transmitter and receiver in spite of flat material present in the gap and even when it is a thick sheet. If the permitted maximum sensor spacing is exceeded and detected, the evaluating device, e.g. a microprocessor, can effect a corresponding correction of the determined amplitude values of the measuring signal as a function of the spacing between transmitter and receiver.

The mutual orientation of transmitter and receiver takes place in the main radiation direction and in particular coaxially and there can be a virtually random inclination angle to the sheet plane. When detecting single or multiple-corrugation corrugated paper, this appropriately takes place approximately orthogonally to the widest surface of the corrugated paper corrugation.

With regards to an optimum detection from the method standpoint it is also possible to provide a feedback between transmitter and evaluating device, particularly a microprocessor, so as to obtain a maximum amplitude at the output, whilst taking account of the material specification of the flat objects to be monitored and further operating conditions. It is also possible to adjust to the optimum transmitting frequency. This measure also makes it possible to compensate ageing effects of the sensor elements and a product testing of the inventive device can be fully automated in a fully advantageous development in connection with industrial scale production.

To achieve an improved detection reliability with respect to labels, splice and break points and tear-off threads, these objects can be moved between transmitter and receiver, so that independently of the specific object measuring signal received the corresponding switching threshold for the target characteristic can be determined automatically or in externally triggered manner.

As from the method and device standpoint label detection appropriately takes place by means of a second channel, this does not affect a learning-free detection for single or multiple sheets implemented with a first channel of the evaluating device.

In an advantageous further development a feedback is provided between the evaluating device and transmitter using a maximization of the amplitude of the incoming measuring signal. There is preferably a self or auto-balancing between the transmitter and receiver with a view to an optimum transmitting frequency and/or amplitude. This auto-balancing can be performed in times synchronized with the transmitting frequency, in fixed defined pause times or by means of a separate input provided externally on the sensor device.

With a view to an optimum process control for plants in which the method and device can be used, for digitizing the analog measuring signal appropriately at least one A/D converter or a threshold generator is provided, so that the further processing of the values can be performed digitally. Particularly when processing and selecting different signals of several signal amplifying devices the control and selection of the corresponding channels and signals is preferably performed using time multiplex devices.

For the better detection of elongated objects and materials laminated onto the base material and more particularly using ultrasonic or optical sensors, it is advantageous to provide between the transmitter and the elongated object to be detected at least one pinhole diaphragm and/or slot diaphragm for improving the spatial resolution and for continuously detecting the presence of the object.

Specifically for improving the detection of material threads adhesively applied to the base or support material, e.g. tear-off threads for the packaging foils of cigarettes, the arrangement of the diaphragms and in particular slit diaphragms takes place in the thread running direction. This normally involves the diaphragm being positioned in the running direction of the elongated objects.

When monitoring scale-like superimposed sheets the slit or pinhole diaphragms are oriented by 90° to the sheet movement direction.

When using diaphragms the elongated object guided between transmitter, receiver and diaphragm, e.g. a thread laminated onto a base material is implemented so as to float as close as possible over or slidingly contact the diaphragm. The arrangement of the transmitter, specifically in the case of ultrasonic sensors, appropriately occurs below the sheet to be detected, because in this case the maximum transmitting energy can be coupled out and use can be made of sensor head self-cleaning effects. However, it is also possible to reverse the arrangement with the receiver, provided that the signal strength loss can be accepted.

Figure 1A:
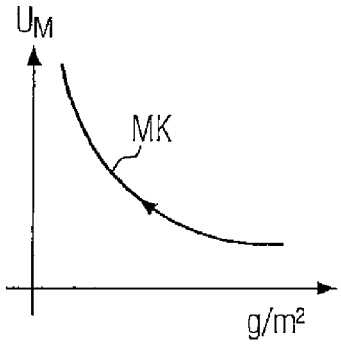
Figure 1B:
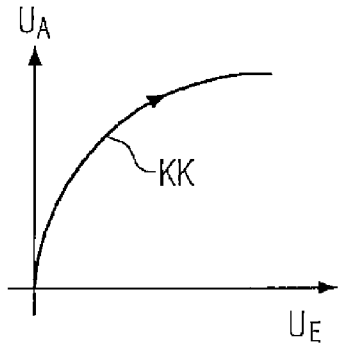
Figure 1C:
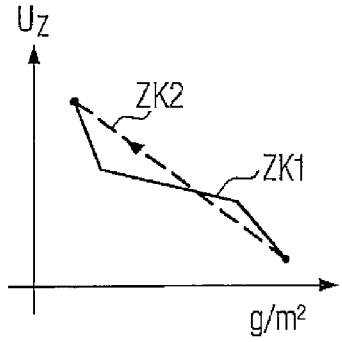

The invention is described in greater detail hereinafter with reference to the basic measuring principles and by means of the diagrammatic representations and graphs, wherein show:

FIG. 1 The principle of an inventive method and in block diagram-like manner a corresponding device whilst using the voltage graphs according to FIG. 1*a*, 1*b*, 1*c*, illustrating the structure of the characteristics when detecting sheets of paper, foils, films or similar materials.

Figure 2:
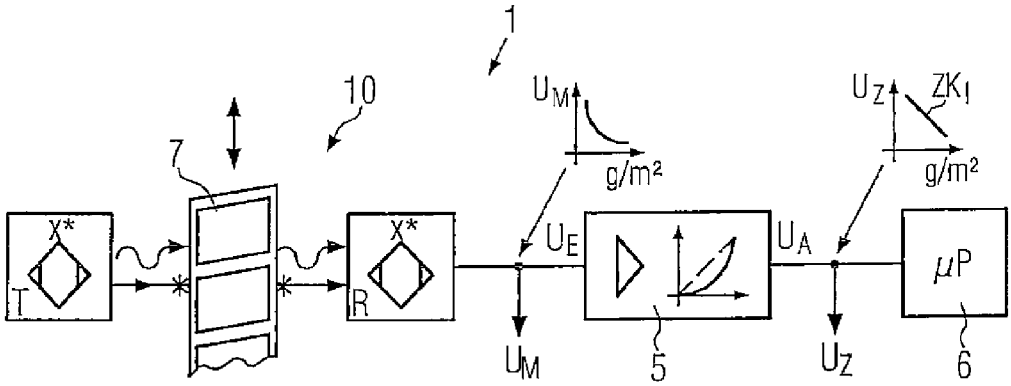

FIG. 2 The principle of an inventive method and in block diagram-like manner a corresponding device using voltage graphs according to FIG. 2*a*, 2*b*, 2*c*, 2*d* illustrating the structure of the characteristics when detecting labels, tear-off points and similar materials.

Figure 3A:
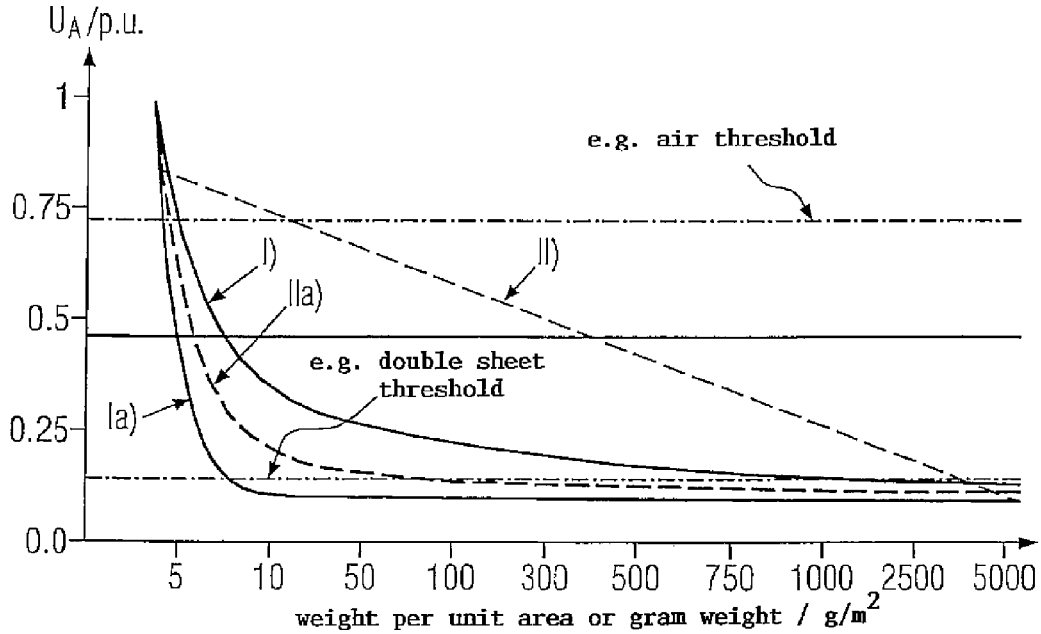

FIG. 3*a* A graph showing the diagrammatic dependence of the output voltage of an amplifier, shown in exemplified manner in FIG. 1, as a function of the gram weight or weight per unit area of the materials to be detected, whilst incorporating idealized target characteristics.

Figure 3B:
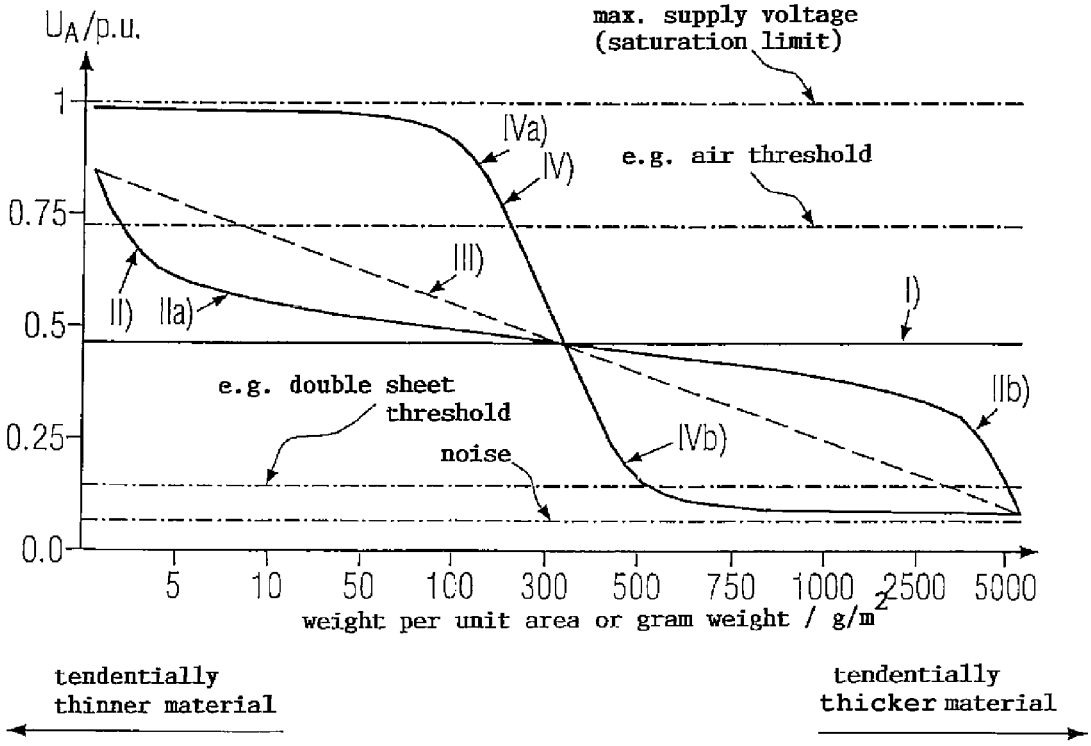

FIG. 3*b* A diagrammatic graph similar to FIG. 3*a* with the output voltage of an amplifier as a function of the gram weight or weight per unit area of the materials under investigation, showing several target characteristics together with corresponding threshold values, e.g. air threshold and double sheet threshold.

Figure 4A:
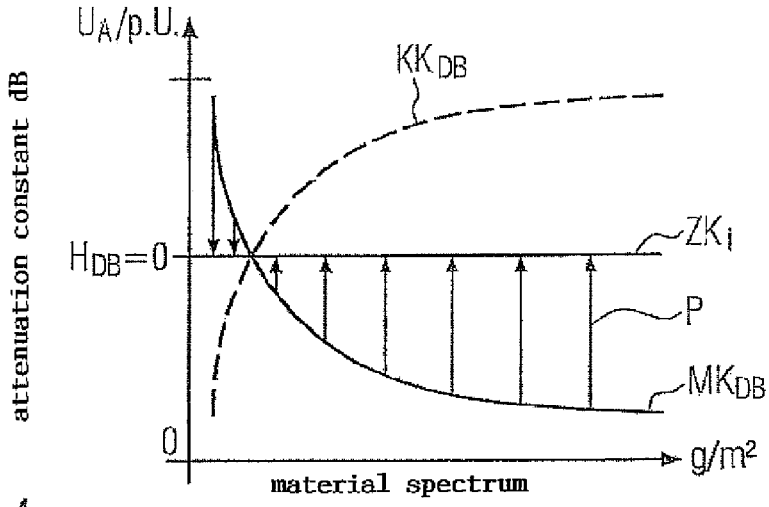

FIG. 4*a* A diagrammatic representation, as to how the correction characteristic can be determined in a known measuring value characteristic and ideal target characteristic for single/double sheet detection in the Cartesian coordinate system.

Figure 4B:
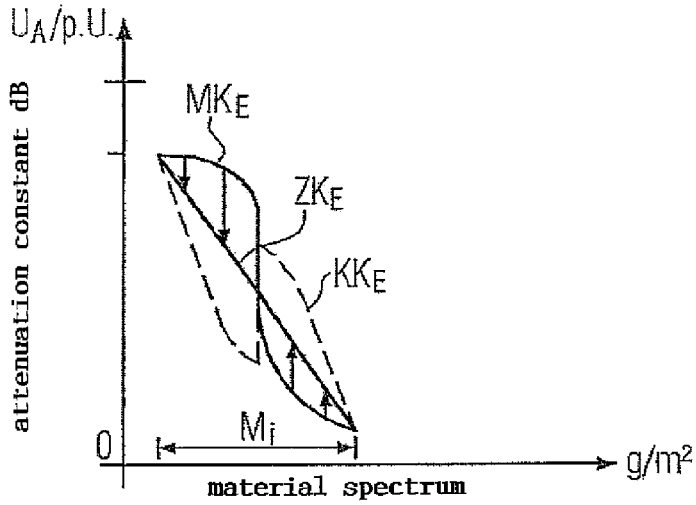

FIG. 4*b* A diagrammatic representation, relative to label detection with ideal target characteristic, known measuring value characteristic and a correction characteristic necessary for transformation.

Figure 4C:
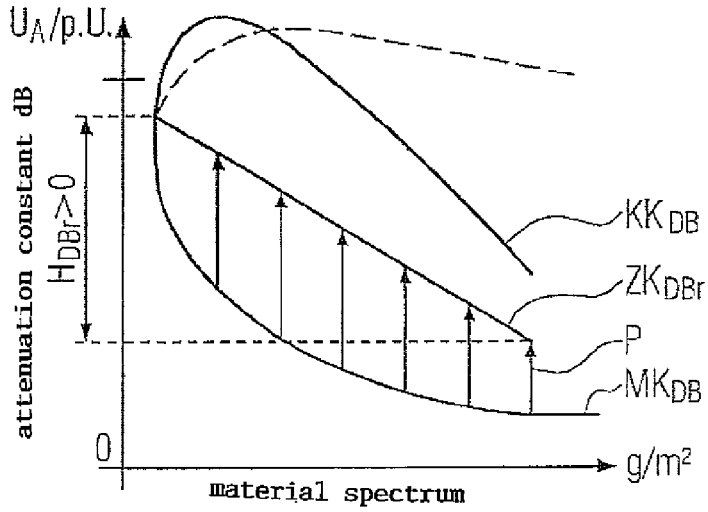

FIG. 4*c* A diagrammatic representation of the characteristics for double sheet detection when there is no ideal target characteristic.

Figure 4D:
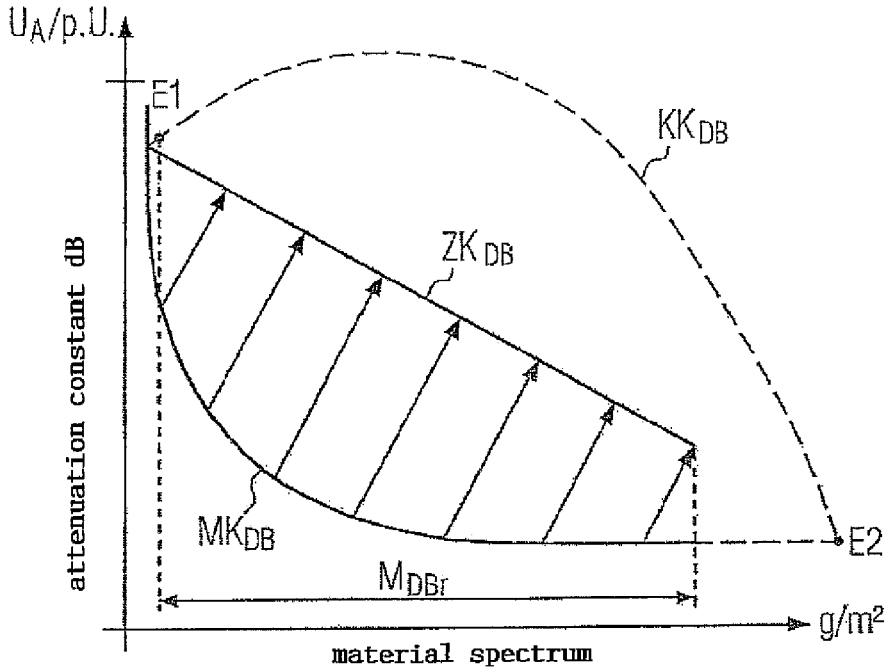
Figure 4E:
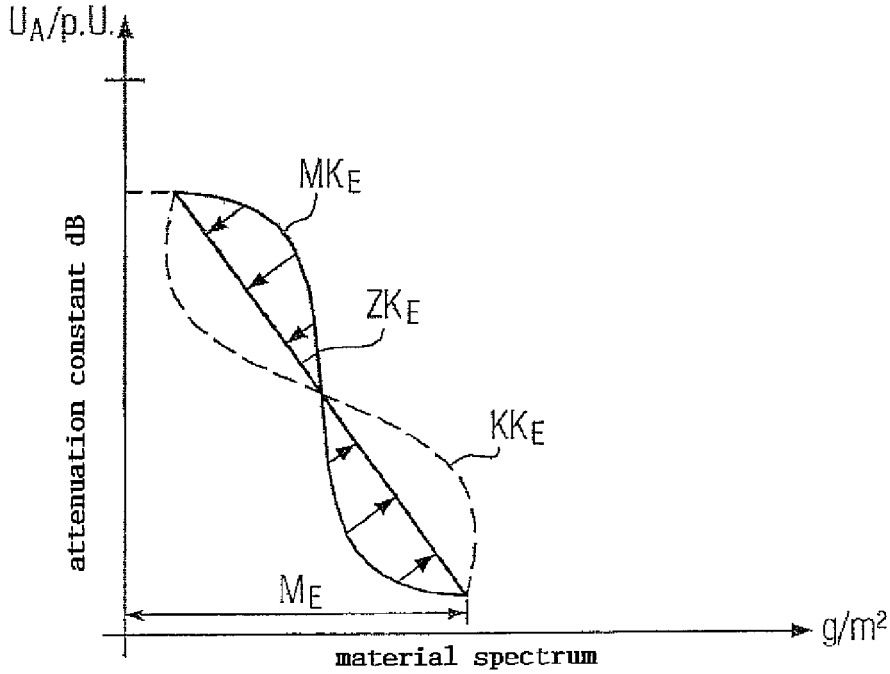
Figure 4F:
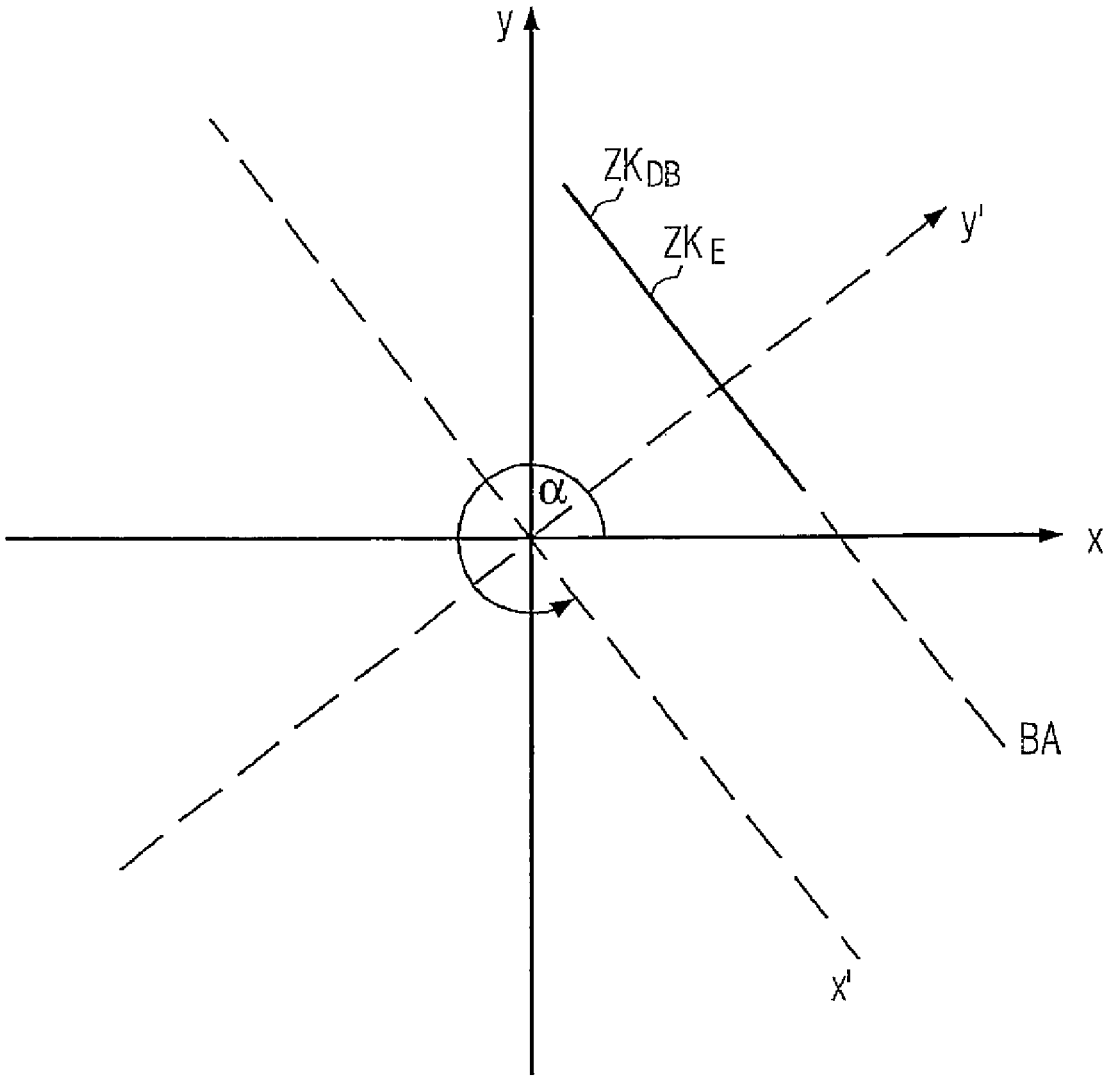

FIG. 4*d* A representation of characteristics for double sheet detection with mirroring on an imaginary axis, using the transformation according to FIG. 4*f*.

FIG. 4*e* A diagrammatic representation of characteristics for label detection with mirroring on the imaginary axis and taking account of FIG. 4*f*.

FIG. 4*f* Diagrammatically a transformation of the Cartesian coordinate system by an angle α with representation of a reference axis of the new coordinate system.

Figure 4G:
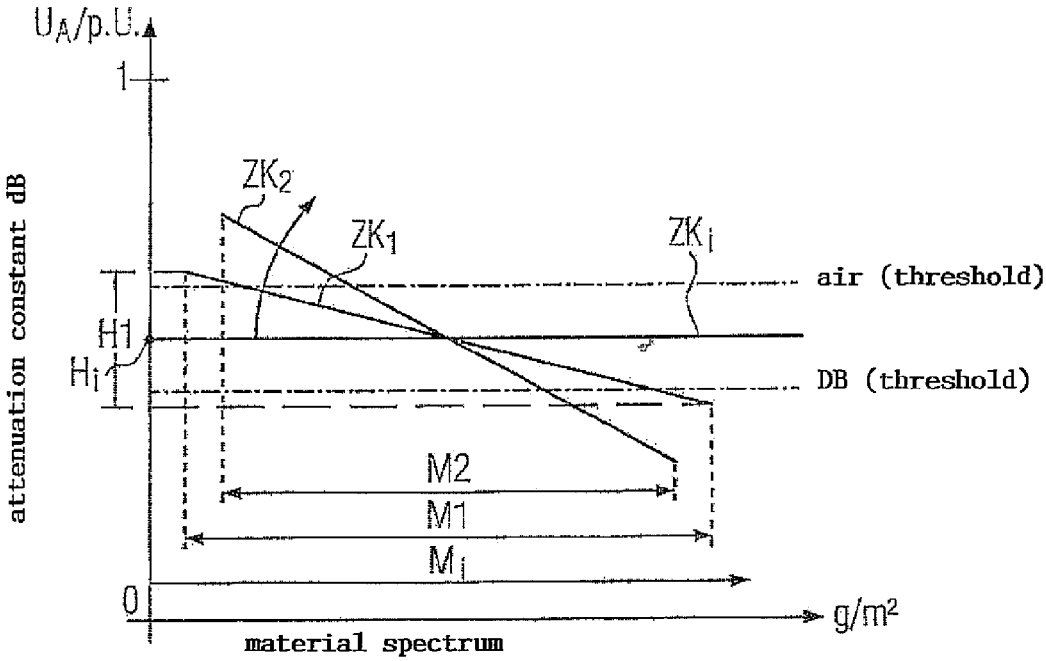

FIG. 4*g* Diagrammatic representations of an ideal target characteristic and real target characteristics in the case of double sheet detection.

Figure 4H:
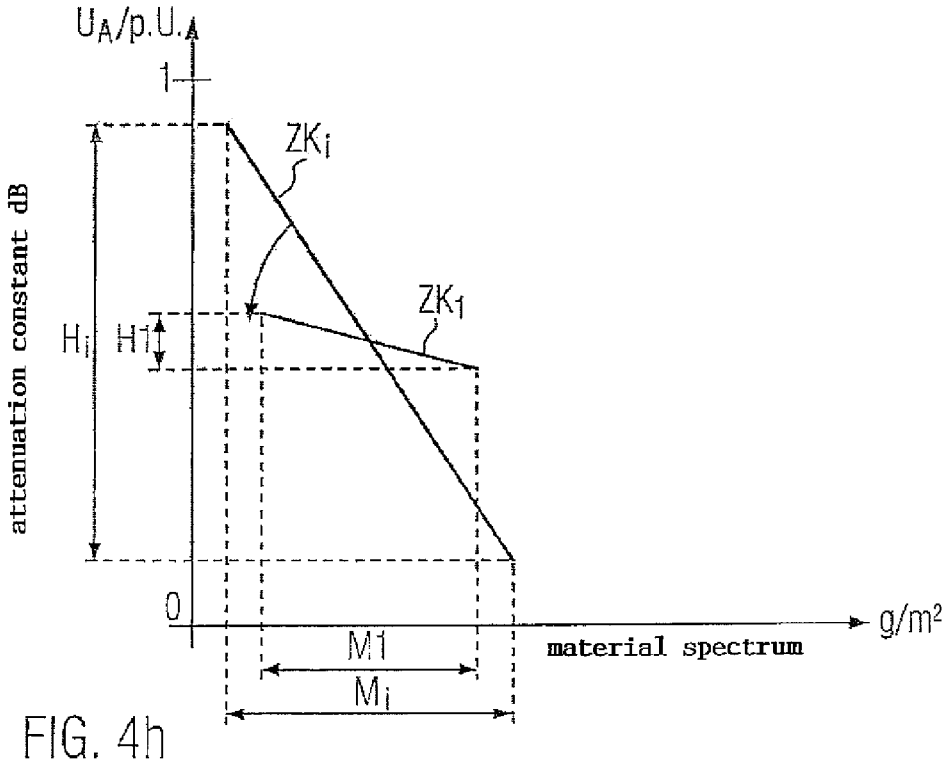

FIG. 4*h* A diagrammatic representation of an ideal target characteristic and a realistic target characteristic for label detection.

Figure 4I:
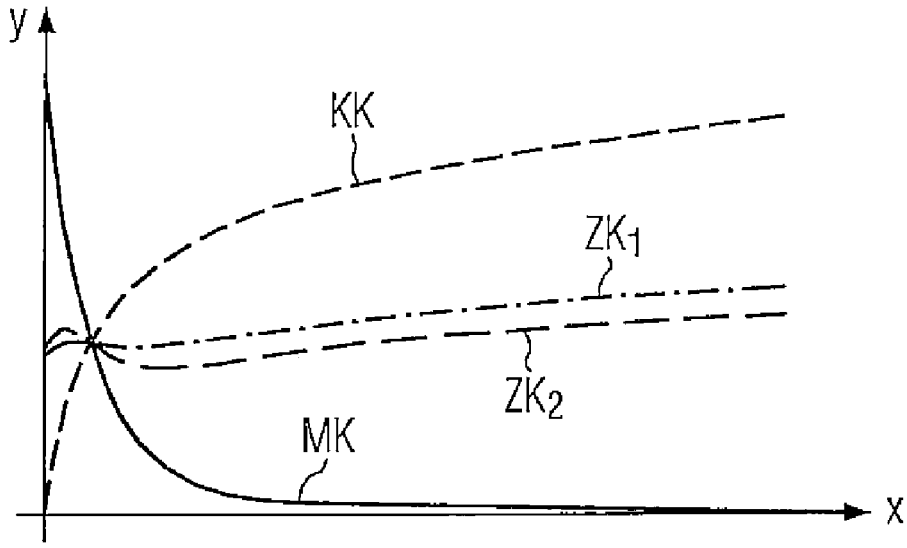

FIG. 4*i* Diagrammatic representations of a measuring value characteristic and correction characteristic in the case of single/double sheet detection, the correction characteristic representing a characteristic defined from an e-function and an inverse function with the target characteristics determined therefrom.

Figure 4J:
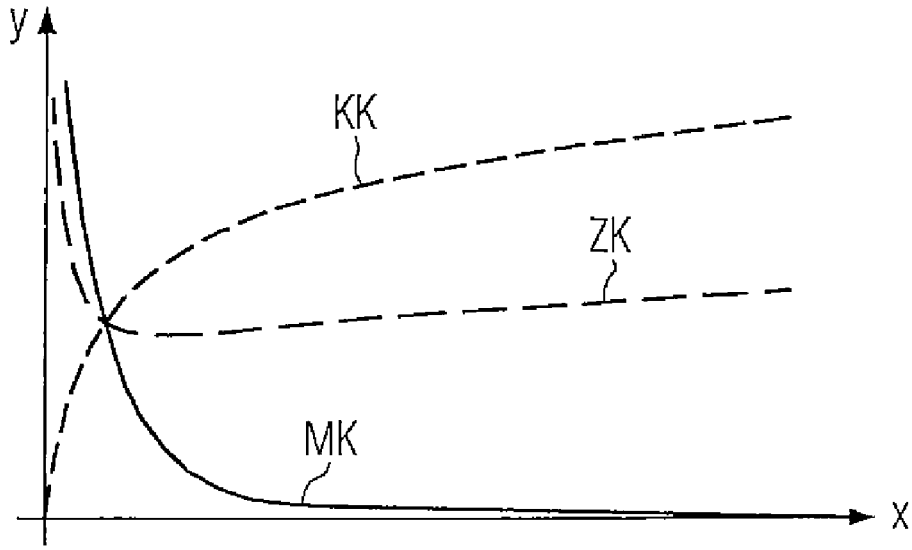

FIG. 4*j* A diagrammatic representation of a measuring value characteristic derived from a weighted hyperbola and a correction characteristic derived from a logarithmic function with the target characteristic determined therefrom for single/double sheet detection.

Figure 5A:
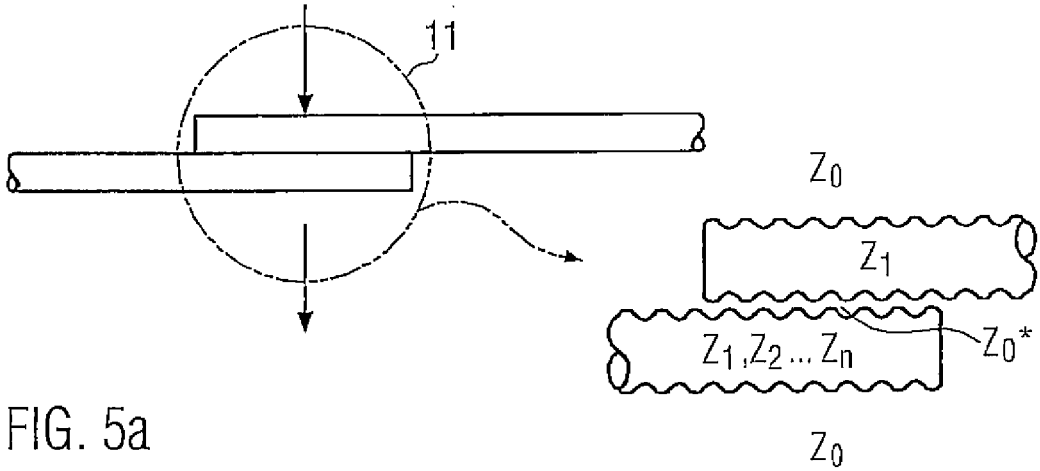

FIG. 5*a* A diagrammatic representation of the measuring criteria present in exemplified manner for the detection of a double sheet of material by ultrasonic waves.

Figure 5B:
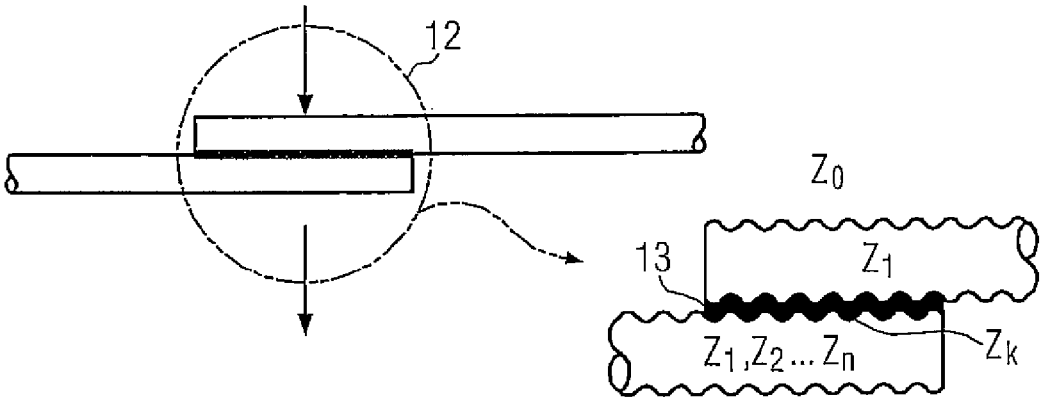

FIG. 5*b* In comparable manner to FIG. 5*a*, the diagrammatic representation of a splice between a material double sheet and the measuring criteria involved in the case of determination using ultrasonics.

Figure 5C:
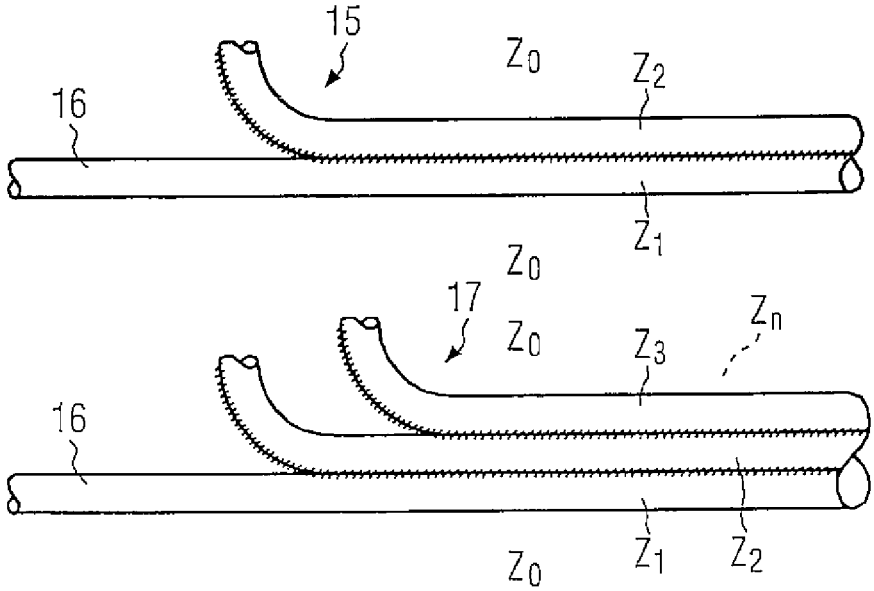

FIG. 5*c* A diagrammatic representation of materials adhesively applied to a base or support material, in part as a single laminated and in part as a multi-laminated material, this showing the structure of a label.

Figure 6:
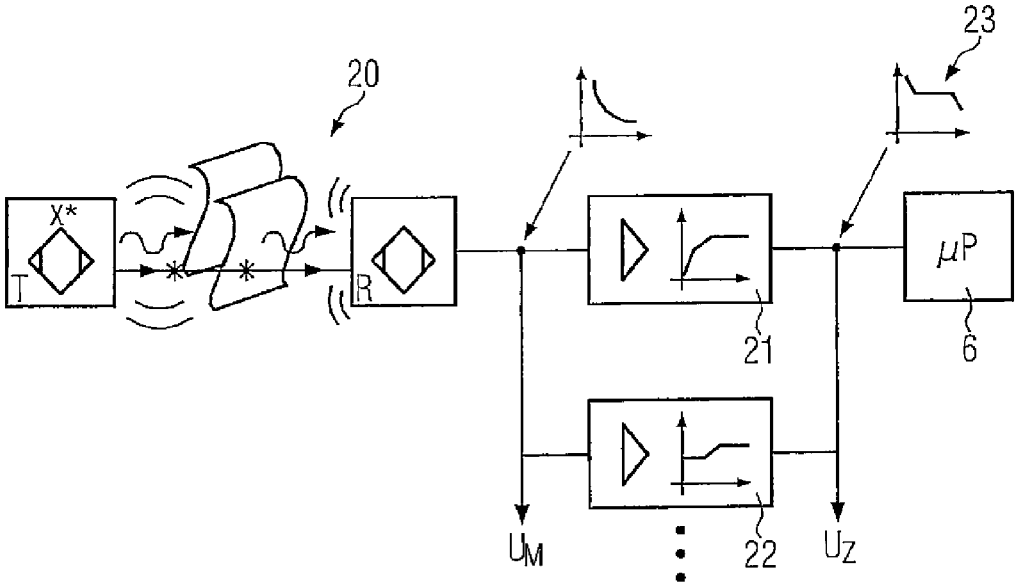

FIG. 6 In block diagram-like manner the representation of the method and a device using the example of a combination of different correction characteristics.

Figure 7:
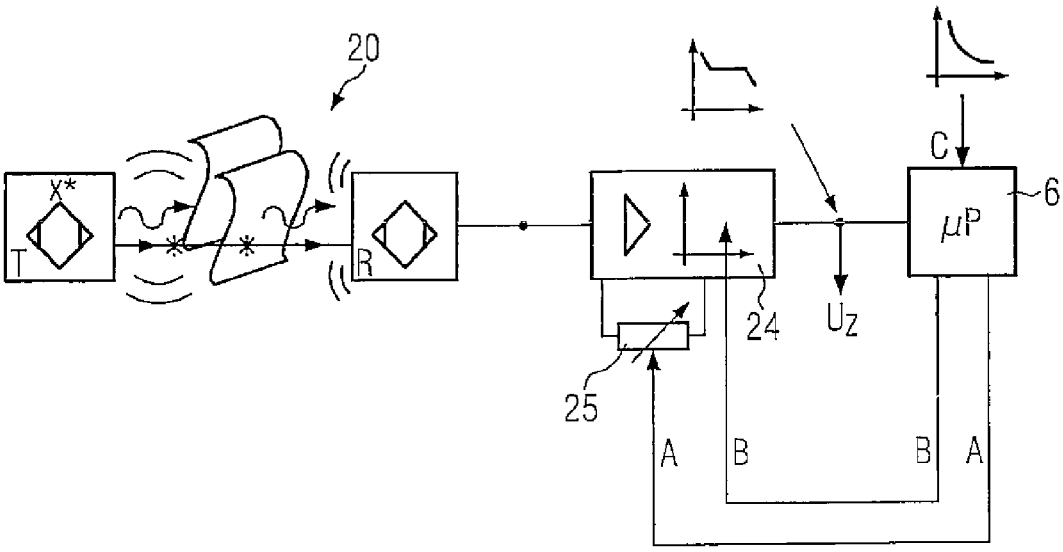

FIG. 7 A diagrammatic representation similar to FIG. 6, the principle being shown for the setting of a correction characteristic and the calculation of a correction characteristic affecting the circuit blocks.

Figure 8:
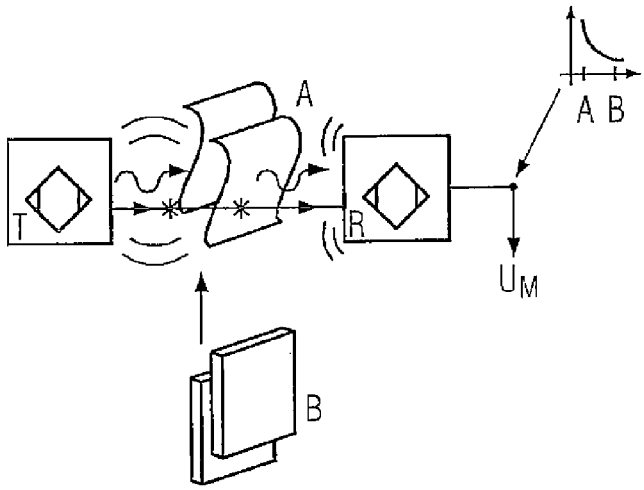

FIG. 8 A diagrammatic representation for empirically determining a measuring value characteristic over a wide gram weight or weight per unit area range.

Figure 9:
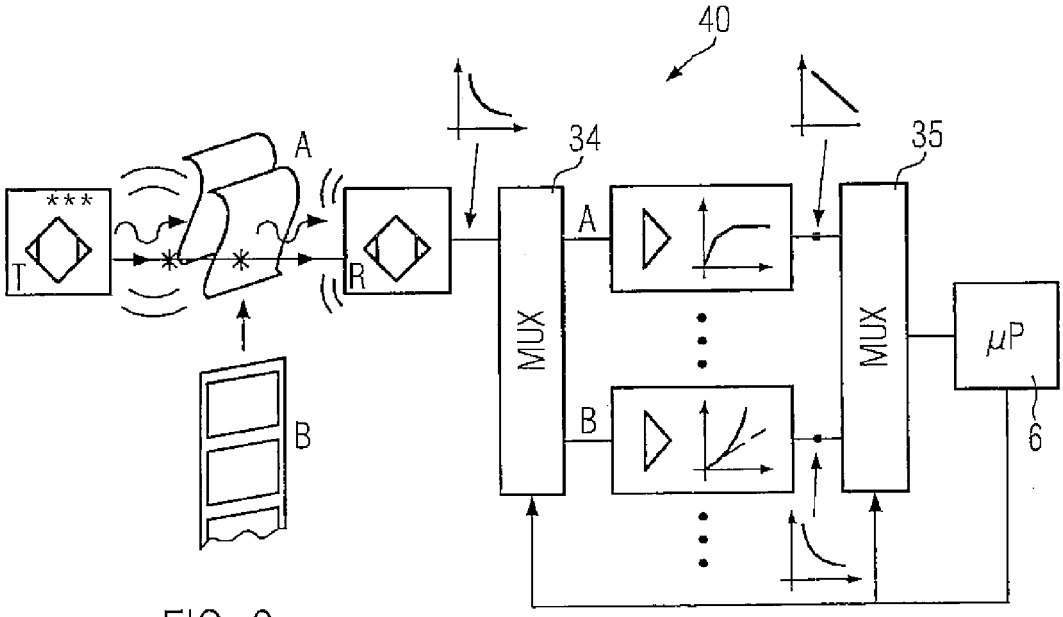

FIG. 9 A block diagram representation of a method and the corresponding device with the combination of e.g. multiple sheet detection with the detection of material layers or labels adhesively applied to the base material.

Figure 10:
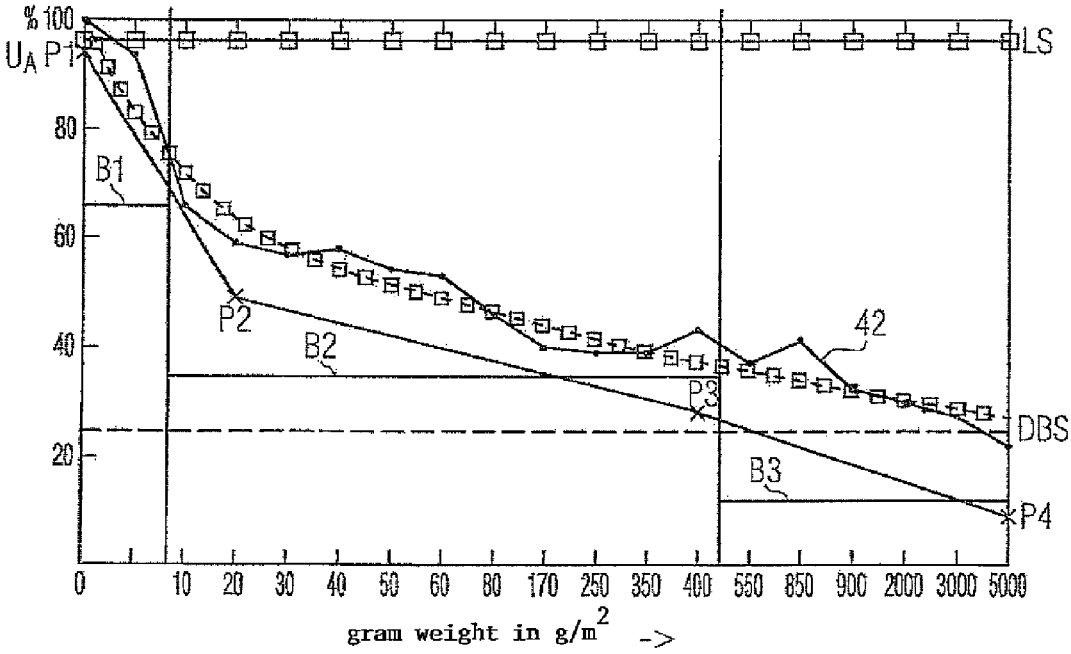

FIG. 10 Diagrammatically a graph of the standardized output voltage $U_A$ over the gram weight range with constant or dynamic double sheet thresholds.

Figure 11:
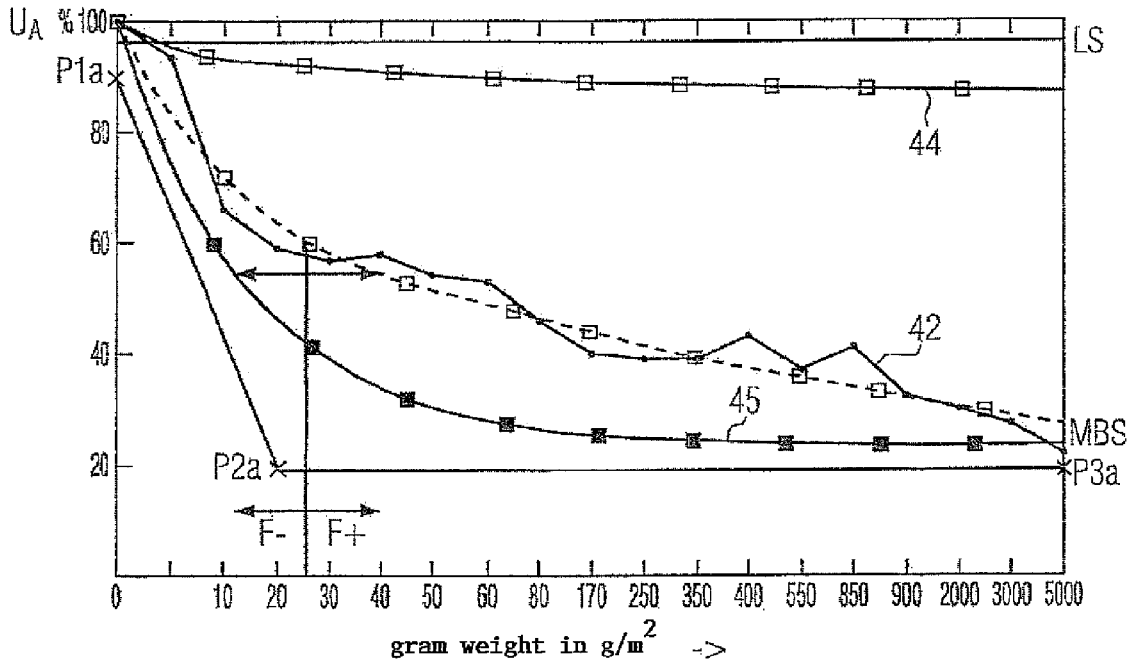

FIG. 11 A target characteristic with plotted upper and lower flutter areas.

Figure 12A:
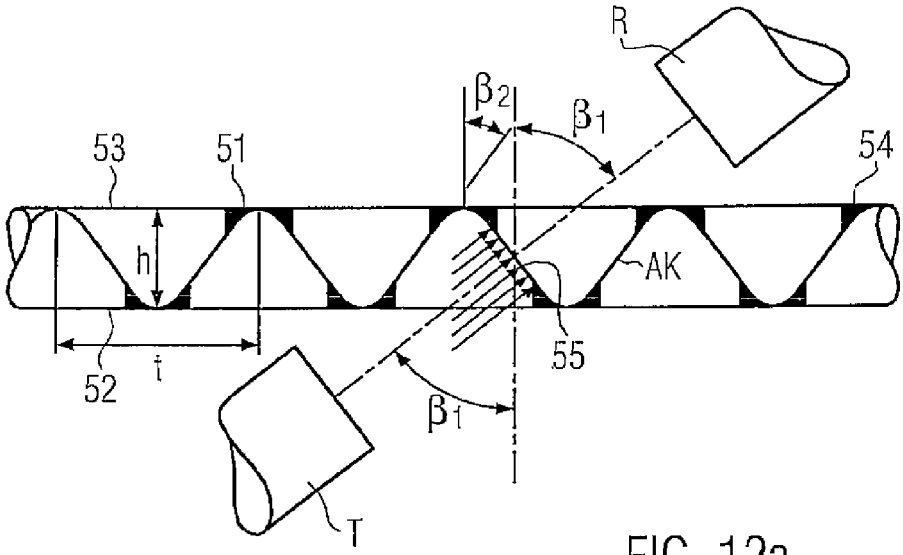
Figure 12B:
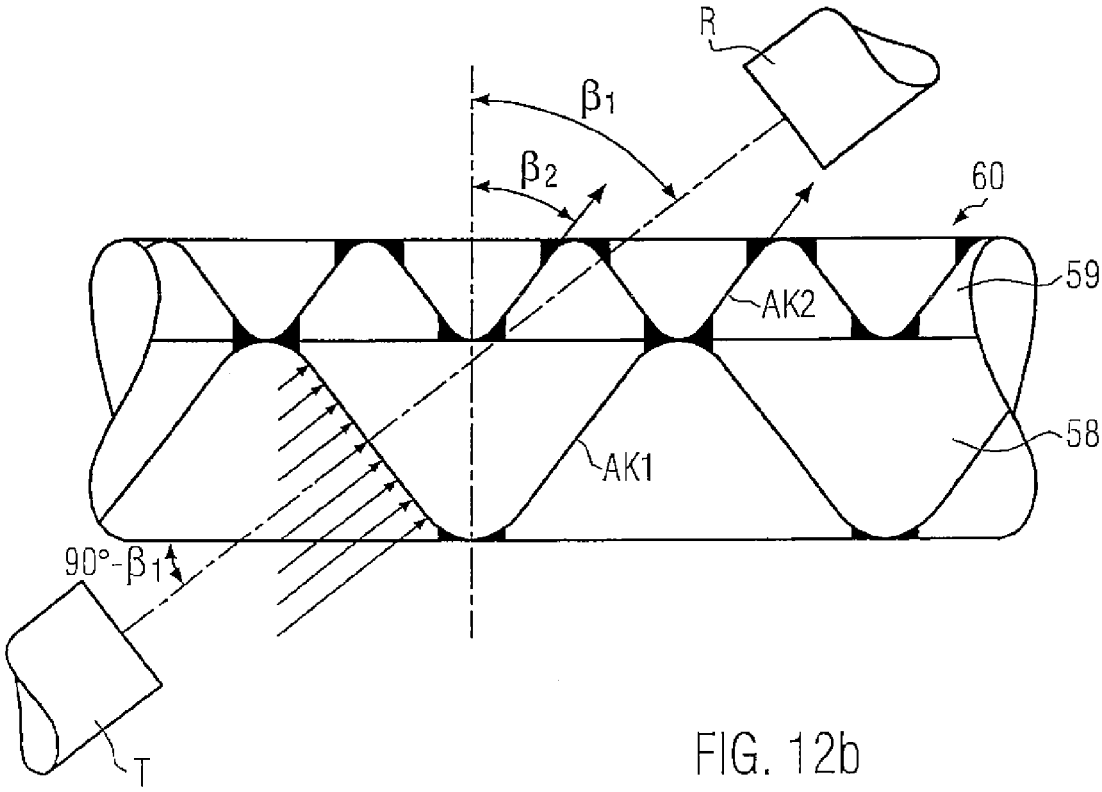

FIG. 12 With the representations of FIGS. 12*a* and 12*b*, the arrangement of a sensor with optimum orientation in the case of single-corrugation corrugated paper and corresponding to FIG. 12*b* the analogous orientation of a sensor in the case of two-corrugation corrugated paper.

FIG. 1 diagrammatically shows the method and device according to the invention with a block diagram structure and the voltage curves attainable at specific points in the sense of characteristics over a gram weight/weight per unit area range g/m$^2$ of a material spectrum to be detected.

Further explanations are based on an ultrasonic sensor device, but in principle it is also possible to use optical, capacitive or inductive sensor devices.

A corresponding sensor device 10 has a transmitter T and a facing receiver R oriented with respect thereto and between which are moved e.g. in sheet form and in contactless manner the flat objects to be detected. FIG. 1 shows in exemplified manner a multiple sheet in the form of double sheet 2.

Since for this example amplitude evaluation of the measuring signal $U_M$ is presupposed for the detection of a single sheet, a missing sheet, i.e. no sheet, or a double/multiple sheet, a possible voltage curve $U_M$ is shown in FIG. 1*a* as a function of the gram weight/weight per unit area g/m$^2$ for the measuring characteristic MK.

With a view to a clear and reliable decision as to whether there is a single, double or missing sheet, the object of the invention, whilst taking account of threshold values, such as e.g. for the air threshold or double sheet threshold, is to obtain clearly defined intersections with said threshold values or maximum voltage spacings with respect to said thresholds.

The fundamental finding of the invention is based on the fact that in the prior art methods and devices, in the case of multiple sheet detection and an assumed, following approximately linear amplification, optionally with further filtering and evaluation, as a function of the gram weight or weight per unit area, a characteristic is obtained for the amplified measuring signal which is substantially strongly nonlinear, particularly exponential, multi-exponential, hyperbolic or the like and over a wide, desired use area of the material spectrum there is frequency an unreliable, error-prone detection and which is now to be changed using a simple principle.

According to the inventive principle account is to be taken of a correction characteristic and this is to be impressed e.g. into the evaluating circuit following the receiver and for this purpose in particular the following amplifier device is suitable, so that over the desired gram weight range there is a readily evaluatable target characteristic for a reliable detection with a decision as to whether there is a single, missing or multiple, especially double sheet.

Such a correction characteristic KK is diagrammatically shown in FIG. 1*b*. This correction characteristic, which only shows in principle in FIG. 1*b* the dependence between the output voltage $U_A$ on the input voltage $U_E$, compared with the measuring characteristic MK according to FIG. 1*a*, which is also only diagrammatically showing the path of the measuring signal $U_M$, shows that relatively high voltage values $U_M$ over the gram weight range are subject to no or only a slight amplification, whereas smaller voltage values, e.g. with relatively high weights per unit area (g/m$^2$) are subject to a much higher and possibly exponential amplification.

The resulting target characteristic ZK with voltage $U_Z$ as a function of the gram weight (g/m$^2$) is also only diagrammatically shown in FIG. 1*c*. The desired ZK can also be transformed to the desired output signal $U_Z$ from a punctiform imaging (implicit KK) of the measuring signal $U_M$ and as a result the desired target characteristic ZK can be obtained. For this purpose it is necessary to have an amplifier with an adjustable amplification or gain, which then obtains the correction characteristic from a μP. The imaging of the measuring signal $U_M$ to the desired output signal $U_Z$ by means of KK can take place in value-continuous manner instead of in value-discrete manner, i.e. in punctiform manner.

In exemplified manner, the target characteristic shown in FIG. 1*c* could have the continuous line form shown, which has three areas. There are first and third relatively steeply falling areas and a central, only relatively slightly abscissa-inclined area, which has a large gram weight range. As the first and third areas could have a more optimum path with a view to a reliable detection display or clear switching behaviour of the device, using a broken line representation is shown in the form of an improved target characteristic a linearly falling target characteristic ZK2 passing through the end points of the first target characteristic ZK1.

In connection with the device 1 for detecting single, missing or multiple sheets shown in block diagram form in FIG. 1, the measuring signal $U_M$ obtained at receiver R is supplied to an evaluating device 4 shown in simplified manner with the amplifier device 5 and downstream of a microprocessor 6.

The correction characteristic KK is given or impressed on the amplifier device 5, so that at the output is obtained target characteristic ZK1/ZK2 for the purpose of further evaluation in microprocessor 6. Whilst taking account of stored or dynamically calculated data, such as threshold values, the microprocessor 6 can generate a corresponding detection signal relative to single, missing or multiple sheets, particularly double sheets.

FIG. 2 and the associated FIG. 2*a*, 2*b*, 2*c*, 2*d* diagrammatically illustrate the method and a device for detecting labels and similar materials without the need for the performance of a learning step. The reference numerals correspond to those of FIG. 1.

The block diagram-like structure shows a transmitter T, e.g. for irradiating ultrasonic waves, and an associated receiver R as a sensor device 10. Labels 7 are passed between transmitter T and receiver R. The function of the device is on the one hand to detect whether or not labels are present and on the other it is also possible to establish the number of labels guided through the sensor device.

The measuring signal $U_M/U_E$ obtained in receiver R when a label is present can e.g. have the diagrammatically intimated characteristic path over the gram weight with an approximately linear, nonlinear, exponential or similar falling course.

Figure 2A:
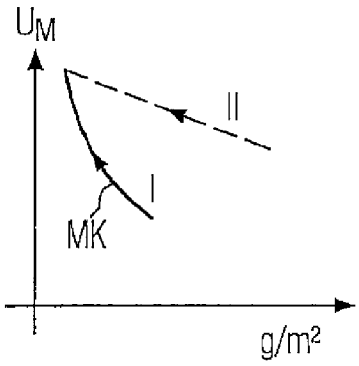
Figure 2B:
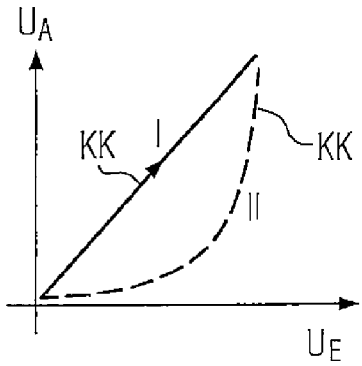
Figure 2C:
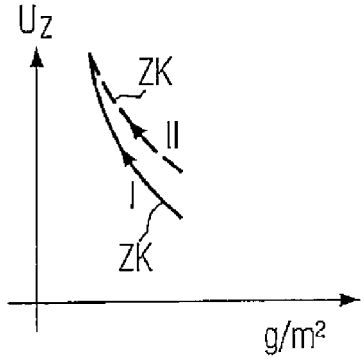

The following evaluating device, which can e.g. have an amplifier device 5 and in downstream manner a microprocessor 6, receives in amplifier 5 a correction characteristic, which can e.g. be linearly rising (I) or exponentially rising (II), as shown in FIG. 2*b*. Whilst taking account of the correction characteristic, e.g. according to FIG. 2*b*, at the output of amplifier 5 is obtained a target characteristic over the gram weight range, as illustrated in FIG. 2*c* by curve I or II.

An ideal path of the target characteristic for label detection is shown in the graph of FIG. 2.

This target characteristic $ZK_I$ has the path of a negatively falling line, from lower to higher gram weights and in optimum manner there is a constant gradient and a maximum voltage difference for output voltage $U_Z$ in the case of small gram weight differences over the entire gram weight or weight per unit area range provided for label detection purposes.

As will be explained hereinafter, the correction characteristic KK can also be a combination of individual, different characteristics. It is also possible to use other correction characteristics, such as logarithmic or multiple logarithmic characteristics, independently of the characteristic path of measuring signal $U_M$ and the amplification characteristic. The aim is to obtain an ideal characteristic $ZK_I$, as shown in FIG. 2.

The curves of FIG. 2*a*, 2*b*, 2*c* show two examples of different characteristics, firstly for measuring signal $U_M$ of FIG. 2*a* with characteristic path MK of a first characteristic I and a characteristic II with interrupted or broken line. These differing characteristics for measuring signal MK I and MK II can be so transformed over correction characteristics KK shown in diagrammatic exemplified form in FIG. 2*b* that at the end of the evaluation it is possible to obtain a characteristic path for the target characteristic ZK corresponding to FIG. 2*c*.

Figure 2D:
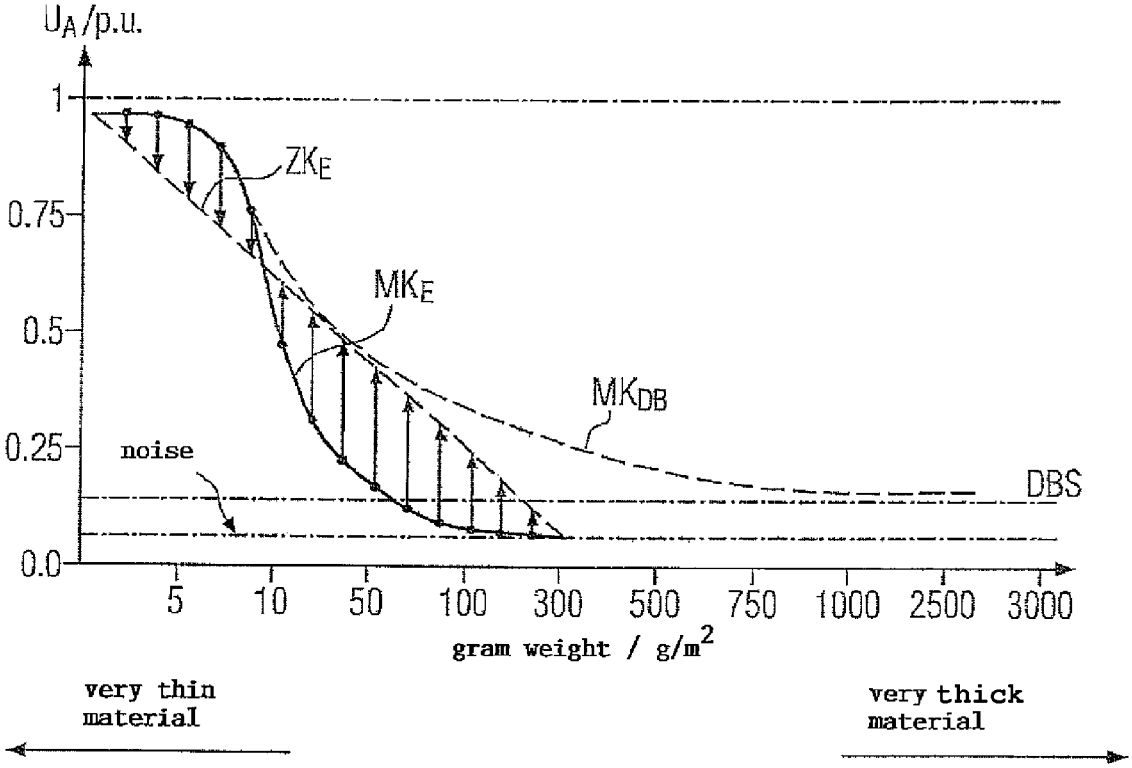

For further illustration purposes FIG. 2*d* diagrammatically shows the output voltage $U_A$ of an amplifier device over the gram weight range with an exemplified path of a measuring value characteristic $MK_E$ for a label and the target characteristic $ZK_E$, as is attainable when taking account of a correction characteristic KK impressed on the amplifier. This representation applies in exemplified manner for the detection of labels/splices. To obtain the desired target characteristic $ZK_E$, the measuring value characteristic $MK_E$ is transformed by means of a suitable correction characteristic KK. This involves each point of the measuring value characteristic $MK_E$ being transformed continuously or in value-discrete manner with digital systems, into a corresponding value on target characteristic $ZK_E$, as is illustrated by arrows.

In the case of very thin materials, e.g. a gram weight between 1 and 8 g/m$^2$, in the input area the amplifying voltage can very easily be in the saturation range. However, when using foils for labels, rapidly the amplifier noise limit range can be reached, because foils very rapidly attenuate. In the graph this can be seen for a gram weight of 100 to 300 g/m$^2$.

Specifically in the case of such measuring value characteristics $MK_E$, the characteristic correction method can be particularly advantageously used, so that a saturation of the measuring signal can be avoided with very thin and strongly attenuating materials, so that ultimately a perfect detection of the presence or absence of labels is ensured.

In exemplified manner for comparing with label detection in FIG. 2*d* is also shown a possible course of the measuring value characteristic $MK_{DB}$ for a single sheet for double sheet detection of preferably paper materials, which in the upper gram weight range roughly asymptotically approaches the double sheet threshold DBS.

The graph of FIG. 3*a* shows diagrammatically the dependence of a standardized output voltage signal $U_A$/p.u. of a signal amplifier as a function of the weight per unit area/gram weight (g/m$^2$) in the case of differently designed signal amplifiers for single and multiple sheets, specifically double sheets. Line I in FIG. 3*a* symbolizes a largely idealized path in the output voltage of single sheets as a function of the gram weight when using an approximately linear signal amplifier 5, there being an approximately exponential voltage line drop. This voltage characteristic I still takes no account of a correction characteristic KK.

Using the nonlinear, particularly logarithmic and/or double logarithmic correction characteristic KK inherent in or impressed on the corresponding signal amplifier, a sought target characteristic II for single sheets is obtained over a very broad gram weight range, i.e. the most varied materials from this roughly exponentially falling voltage characteristic I. The target characteristic II consequently symbolizes a characteristic for the output signal in the case of single sheets using a logarithmic signal amplifier, the target characteristic II having an approximately linear drop.

As switching thresholds FIG. 3*a* on the one hand plots the air threshold and on the other the double sheet threshold. The intersections of target characteristic II according to FIG. 3*a* with the air threshold or double sheet threshold reveal an adequate steepness around a clearly defined, relatively small material range.

The largely asymptotic course of curve I in the vicinity of the double sheet threshold is obtained through the inventively provided transformation of a curve I with a correction characteristic KK to target characteristic II, so that there is a greater spacing of the voltage value for single sheets compared with the double sheet threshold for heavier gram weights or weights per unit area.

This example illustrates the fact that, according to the invention, it is readily possible to bring about the detection as a "missing sheet" or "air" or as a "multiple or double sheet" over a wide gram weight or weight per unit area range without using a learning process.

A signal transformation of measuring signal $U_M$ to a constant output signal $U_A$ of the single sheet over the entire gram weight range with in the ideal case a median voltage value between the two thresholds, namely the upper threshold for missing sheet or air and the lower threshold for multiple or double sheets, would be the optimum solution, i.e. would correspond to the ideal single sheet target characteristic ZK. This ideal target characteristic is marked I in FIG. 3*b*.

FIG. 3*a* also shows a curve Ia, which represents a multiple sheet signal, particularly a double sheet signal when using an approximately linear signal amplifier, the curve Ia having an approximately double-exponential drop of the multiple sheet characteristic. Curve Ia symbolizes a multiple sheet signal, particularly a double sheet signal, with a logarithmic correction line, so that approximately there is a single-exponential drop of the multiple sheet characteristic IIa.

FIG. 3*b* shows several target characteristics of single sheets with the representation of the standardized output voltage $U_A$/p.u. of the signal amplifier as a function of the gram weight/weight per unit area (g/m$^2$) using different signal amplifiers.

Different limit and threshold values are plotted. Thus, the top, horizontal, broken line indicates in exemplified manner the saturation limit or maximum supply voltage for a signal amplifier used. In exemplified manner is represented at approximately 0.7 $U_A$/p.u. the threshold value for air or a missing sheet. At a value of $U_A$ of approximately 0.125 is plotted the double sheet threshold and below it the threshold for noise of electric signal amplifiers.

Horizontal line I in FIG. 3*b* indicates an ideal target characteristic for single sheets, which has no saturation for thin materials and a significant spacing from the noise/double sheet threshold. This ideal target characteristic means that the output voltage $U_A$ of signal amplification when using different gram weights/weights per unit area would ideally give a constant signal. As there are high signal-to-noise ratios in the case of this ideal target characteristic for single sheets as compared with the plotted thresholds, it is possible to assume a reliable switching and detection of single, missing or double sheets.

Curve II represents a nonlinear target characteristic with two branches IIa and IIb, which is relatively difficult to implement due to the inflexion or reversing point, but which can be looked upon as a characteristic approaching the ideal target characteristic I for single sheets.

The relatively flat or shallow partial areas of IIa and IIb could be implemented if area IIa is implementable for lighter gram weights appropriately via an almost linear signal amplification. Area IIb for heavier gram weights can e.g. be implemented by means of a double logarithmic signal amplification, the strongly downwardly falling knee or kink would be too difficult to technically implement due to the attenuation characteristics of papers having a very high gram weight.

Curve III is a target characteristic with the end points of curve II in the simplest manner by means of a 2-dot line connection approaching an ideal path as in the case of curve I. For example, this can be achieved through the use of an at least single logarithmic signal amplifier and shows the linearization of the measuring values for single sheets over a wide gram weight range and taking account of a corresponding correction characteristic.

Curve III has clear passages for the threshold values for air or a double sheet, so that there are clear switching points and detection criteria relative to said threshold values. Thus, target characteristics according to curves I, II and III permit clear detections over a wider material spectrum than in the prior art.

Curve IV shows an unsuitable target characteristic for single sheets. On the one hand in the upper area there is an asymptotic path of curve IV to the saturation limit and on the other in the lower area to the noise threshold. Such an asymptotic path should also be avoided with respect to the air/double sheet switching thresholds, because as a result of limited signal differences with respect to said thresholds a clear distinction of the states, missing sheet or double sheet, would then be problematic.

The steep drop of curve IV in the central area in this example only covers a small gram weight range with a clear distinction between missing or double sheets. Since, according to the invention, the target characteristic would allow a clear detection for single, missing or double sheets over a very wide material spectrum, a path in accordance with curve IV should be avoided.

The principles of the invention illustrated in FIGS. 1, 2, 3*a* and 3*b* consequently show that in evaluating the incoming measuring signal, the use of a signal amplification supplied with a correction characteristic is used and appropriately simulates the characteristic of the output voltage $U_A$/p.u. as a function of the gram size of the flat objects over a large gram size range inversely or almost inversely or approaching the ideal characteristic for single sheet detection. In this way a linear or almost linear dependence is obtained between the measuring signal $U_E$ received from the receiver and the signal voltage $U_A$ at the signal amplifier output.

FIG. 4*a* diagrammatically shows in the Cartesian coordinate system with material spectrum g/m$^2$ on the abscissa and the percentage signal output voltage $U_A$ on the ordinate an exemplified path of a measuring value characteristic $MK_{DB}$ for detecting single/double sheets.

The ideal target characteristic $ZK_i$ for detecting single, missing or double sheets is a constant with the gradient O ($H_{DB}$=0). The necessary correction characteristic $KK_{DB}$ is also shown for this example and makes it clear that initially there is a downward transformation of the points of the measuring value characteristic MK in the direction of arrows P and then an upwards transformation for larger gram sizes in order to obtain the ideal target characteristic $ZK_i$ for single sheet detection.

The example according to FIG. 4*b* shows corresponding paths of the characteristics for labels. The measuring value characteristic $MK_E$ is shown in exemplified manner with continuous lines. The ideal target characteristic $ZK_E$ is a straight line with a negative gradient or high swing.

The correction characteristic $KK_E$ necessary for transformation is shown in broken line form and has in this case a discontinuity point at the intersection between measuring value characteristic $MK_E$ and target characteristic $ZK_E$.

FIG. 4*c* diagrammatically shows the path of the characteristics for single/double sheet detection for a case in which a real target characteristic $ZK_{DBr}$ is obtained and not the ideal target characteristic. The real target characteristic $ZK_{DBr}$ consequently has a swing $H_{DBr}$ exceeding 0. The plotted measuring value characteristic $MK_{DB}$ could in this case be transformed into the target characteristic $ZK_{DBr}$ by the impression of e.g. correction characteristic $KK_{DB}$ as the upper, continuous line. This transformation is illustrated by arrows P.

FIG. 4*d* diagrammatically shows the transformation of a measuring value characteristic $MK_{DB}$ for single/double sheet detection to the desired target characteristic $ZK_{DB}$. The abscissa characterizes the material spectrum g/m$^2$, the realistic measuring range being $M_{DBr}$. The signal output voltage $U_A$ of the measuring value is indicated percentagewise on the ordinate and roughly corresponds to the attenuation constant dB. The virtual end points E1 and E2 are shown as imaginary intersections of the measuring value characteristic $MK_{DB}$ with the target characteristic $ZK_{DB}$.

In the case of a known measuring value characteristic $MK_{DB}$ in the case of a double sheet detection it is consequently necessary for obtaining a linear target characteristic $ZK_{DB}$ to have a correction characteristic $KK_{DB}$, as shown in broken line form between end points E1 and E2. Thus, conceptually the transformation of the measuring value characteristic $MK_{DB}$ takes place in the direction of the arrows to the real target characteristic $ZK_{DB}$. This is brought about by a mirroring of the measuring value characteristic $MK_{DB}$ on axis $ZK_{DB}$ after coordinate transformation. This coordinate transformation from the Cartesian coordinate system into a new coordinate system x', y' is shown in simplified form in FIG. 4*f*.

The further representation of FIG. 4*e* diagrammatically shows the transformation of the measuring value characteristic $MK_E$ in the case of labels into the desired, ideal target characteristic $ZK_E$ by means of the necessary correction characteristic $KK_E$.

In the case of a known measuring value characteristic $MK_E$, the correction characteristic $KK_E$ can be obtained by the mirroring of $MK_E$ on the axis of the target characteristic $ZK_E$ following coordinate transformation (cf. FIG. 4*f*). The coordinate transformation shown in FIG. 4*f* illustrates in simplified manner the displacement for a linear coordinate system x, y by an angle α. X, y being e.g. the axes of the Cartesian, linear coordinate system.

Through the coordinate transformation the new coordinate reference system is provided by the imaginary reference axis of target characteristic $ZK_{DB}$ or $ZK_E$. Whilst retaining the Cartesian coordinate system the following applies for the transformation:

$$x' = -x \cdot \cos\alpha + y \cdot \sin\alpha;$$

$$y' = -x \cdot \cos\alpha + y \cdot \sin\alpha.$$

With a view to the necessary correction characteristic KK, this is only obtained following coordinate transformation in connection with the realignment through the desired target characteristic $ZK_{DB}$ or $ZK_E$ by mirroring on the corresponding target characteristic $ZK_{DB}$ or $ZK_E$.

FIGS. 4*g* and 4*h* diagrammatically shows the fundamental difference between the ideal and real target characteristic for single/double sheets (FIG. 4*g*) and label detection (FIG. 4*h*).

FIG. 4*g* for the single sheet shows the ideal target characteristic $ZK_i$, which is ideally linear and has no gradient, i.e. is constant. The swing $H_i$=0 would be present over the entire ideal range over material spectrum $M_i$. In the case of single sheet detection, with such an ideal target characteristic $ZK_i$ there would be a maximum spacing from the upper air threshold and a maximum spacing from the underlying double sheet threshold.

The arrow in the diagram indicates the transition from the ideal target characteristic $ZK_i$ to the real target characteristics, e.g. $ZK_1$ or $ZK_2$.

It can be seen that the flatter the real target characteristic, the wider the detectable material spectrum $M_1$ or M2.

FIG. 4*h* shows a comparable diagram to the target characteristics ZK for label detection. The ideal label detection target characteristic $ZK_i$ has a maximum swing $H_i$ over a relatively wide range of the material spectrum, which is designated as the ideal material spectrum $M_i$.

However, real target characteristic $ZK_i$ in the case of label detection diverge from the ideal target characteristic $ZK_i$ in the direction of the arrow. Correspondingly the more real target characteristic $ZK_i$ has a smaller swing $H_i$ and also a small material spectrum $M_1$.

Thus, the steeper the real target characteristic and the more it approaches the ideal target characteristic $ZK_i$, the more swing is available for a given material spectrum.

FIGS. 4*i* and 4*j* show exemplified measuring value characteristics and correction characteristics and target characteristics derived therefrom.

Thus, FIG. 4*i* shows a measuring value characteristic MK, which could be used for a specific material spectrum for single/double sheet detection. The correction characteristic KK has the function y=−ln(1/x)+3.

The correction characteristic is derived from an e-function and an inverse function x=ln(1/y). Thus, the target characteristics $ZK_1$ and $ZK_2$ shown can be derived from the measuring value characteristic MK and the correction characteristic KK, essentially through the difference.

The example of FIG. 4*j* diagrammatically shows characteristics for single/double sheet detection. In this example the measuring value characteristic MK is approximately derived from a weighted hyperbola. The correction characteristic KK is a correction characteristic derived from a logarithmic function. In this example and taking account of the correction characteristic KK, the measuring value characteristic MK can be transformed into a target characteristic ZK, which approximately corresponds to an ideal target characteristic for single/double sheet detection.

On the basis of FIGS. 5*a*, 5*b* and 5*c*, hereinafter are explained certain fundamental principles of the inventive method and the corresponding device using the example of an ultrasonic sensor device and the physical differences essential for clear detection by means of a double sheet, a double sheet with splice and using the example of labels. These fundamental considerations at least partly also apply to other sensor devices, e.g. of an optical, inductive or capacitive nature.

FIG. 5*a* diagrammatically shows the overlap of two single sheets, so that in the overlap area reference can be made to a double sheet 11. This double sheet 11 comprises two paper sheets, the gap between the two single sheets being a medium different from the material thereof. As contactless detection takes place, it can be assumed that air with the parameter $Z_0$ is present on either side of the double sheet and that also the intermediate medium in the single sheet overlap area is air with $Z_0$, which is present in said double sheet as an air cushion as a result of the surface roughness of these materials.

The action direction of the e.g. ultrasonic measuring method is in the present example perpendicular to the double sheet area, so that a transmitted ultrasonic signal in the case of such a "true double sheet" as a result of multiple refraction over at least three interfaces is very small, i.e. the transmission factor over three layers ideally tends towards zero.

Thus, considered more generally, a double/multiple sheet can be looked upon as a material structure having a sheet lamination or box layering and in one of the gaps between the layering or lamination there is at least one medium differing from the different sheet materials and in particular air, which in the case of an ultrasonic measuring method has a clearly differing acoustic resistance compared with the sheet materials and consequently leads to signal reflections. On inserting two or more sheets the signal attenuation by signal refraction and reflection is so great that the emitted signal is strongly overproportionally attenuated. In other measuring methods this applies to the opacity and the surface characteristics colour and thickness, another dielectric, other electromagnetic conductivity or other magnetic attenuation.

Such a double sheet also covers the case of a connection between sheets, which is non-adhesive, e.g. using mechanical serration or edging of the sheets, because the corresponding intermediate medium would again be air. This consideration also applies to multiple sheets, where three or more individual sheet material layers are superimposed.

FIG. 5*b* diagrammatically shows a double sheet 12 with splice 13. The action direction of the measuring method used, once again ultrasonics being assumed, is indicated by arrows.

A splice in this connection is considered to be abutting, more or less overlapping or similar connections of sheets, particularly paper sheets, plastics, foils, films and fabrics (fleeces). The connection mainly takes place by a medium adhering to part or all the surface and in particular using adhesive strips or adhesives on one or both sides.

Thus, physically, a splice for an ultrasonic method represents an "acoustic short-circuit" through the adhesive material layer $Z_k$ filling and intimately joining the gap between upper sheet $Z_1$ and lower sheet $Z_2$, air $Z_0$ being assumed as present above and below the single sheet. Thus, in the ultrasonic detection process a splice could essentially be detected as a single sheet with a high gram weight.

FIG. 5*c* diagrammatically shows two embodiments of labels 15, 17. Within the scope of the present invention the term label is understood to mean one or more material layer or layers adhesively applied to a base or support material. The laminated material, e.g. with respect to sound emission to the outside, behaves in the manner of a composite material piece, so that in part there is no significant attenuation of the given physical quantities and instead only a comparatively limited, but still readily evaluatable attenuation. In this consideration no account is taken of possible inhomogeneities in the base material or the applied material, because particularly with labels perfect material can be assumed.

In the example according to FIG. 5*c*, label 15 has an upper material with parameter $Z_2$ applied to a base material by an intimate adhesive joint. Air with the parameter $Z_0$ is present on both label sides. As a result of this intimate adhesive joint between the materials an acoustic short-circuit is present in the case of an ultrasonic detection process, so that there is an analogy to the splices according to FIG. 5*b*.

The same also applies regarding label 17 in FIG. 5*c*, which solely differs from label 15 by a second, top-applied material layer. Here again an acoustic short-circuit between the materials can be assumed.

These fundamental considerations within the scope of the invention in connection with the detection of double sheets, splices, labels and the like, consequently makes it possible by means of the inventive method or device to detect differently stacked single sheets or multistacked materials and also distinguish the same. It is consequently possible to detect or count labels applied to flat materials and which have an object gap between them.

FIG. 6 shows in block diagram form a device for detecting missing, single and multiple sheets, the correction characteristic being produced as a combination of individual characteristics.

The flat materials or sheets to be detected are passed between transmitter T and receiver R. The correction characteristic resulting from amplification is in the present example implemented with a first correction characteristic in amplifier device 21 and at least one second correction characteristic in amplifier device 22, which are connected in parallel. The measuring signal or its characteristic path over the gram size present at the output of receiver R is consequently subject to a combined correction characteristic in order to obtain a readily evaluatable target characteristic 23, which is further processed in a microprocessor 6.

In connection with the combination of correction characteristics this can also be implemented in a signal amplifier or in several series or parallel-connected, individual signal amplifiers in order to produce an overall gain. Thus, correction characteristic implementation can take place in the most varied ways, because the essential idea of the invention is to detect single, missing or multiple sheets over a wide gram size range without having to integrate a learning process.

FIG. 7 shows in block diagram form a modified device for implementing the invention. The measuring signal of receiver R is subsequently passed to an amplifier device 24, whose signal output is led to a microprocessor 6. In this example and by means of feedback in path A, microprocessor 6 permits the setting of a predetermined correction characteristic via symbolized potentiometer 25.

In alternative circuitry a corresponding correction characteristic is calculated by means of microprocessor 6 and the obtained or stored data and via path B is fed back and impressed on amplifier device 24.

It is also possible to determine a correction characteristic empirically or via the measurement of a representative material spectrum which is to be detected and input it to the evaluating unit including microprocessor 6. The determined correction characteristic C over path B can be impressed in value-discrete or value-continuous manner on amplifier device 24 or the evaluation of the amplified output signal can be performed directly in microprocessor 6 on the basis of correction characteristic C.

FIG. 8 diagrammatically shows the empirical determination of a measuring signal characteristic. For this purpose a plurality of commercially available materials are passed between transmitter T and receiver R and by means thereof the corresponding measuring signal characteristic is determined. Normally the measuring range is fixed by the introduction of the thinnest available sheet material A and the thickest sheet material B to be detected. The thus determined measuring signal characteristic can then be supplied to the further processing system, e.g. a microprocessor, in order to determine in connection with said measuring signal characteristic a substantially optimum correction characteristic so as to achieve the requisite target characteristic.

FIG. 9 diagrammatically shows an inventive device 40 for the contactless detection of multiple sheets A, without performing a learning step, and the detection of material layers B, e.g. labels adhesively applied to a base material.

A fundamental principle in this connection is to supply the measuring signal evaluation for multiple sheets to a separate channel A with corresponding correction characteristic and in parallel therewith supply the measuring signal evaluation for labels B to a separate channel B with adapted correction characteristic.

The measuring signal obtained at the output of receiver R is therefore switched to the corresponding channel A or B by means of a multiplexer 34 controlled by microprocessor 6. Signal amplification in channel A is subject to a separate correction characteristic with optimum design for multiple sheet detection. Signal amplification in channel B is subject to a correction characteristic or the label measuring signal. By means of a following, microprocessor-controlled multiplexer 35, both channels A, B are supplied to the downstream microprocessor 6 for further evaluation and the detection of multiple sheets or labels.

Device 40 is suitable for detection using ultrasonic waves. The essential advantage is the planned possibility of being able to incorporate for evaluation purposes the in each case most suitable correction characteristics for fundamentally differing measuring tasks, namely for the most varied material types, as in the present case multiple sheets and labels.

FIG. 10 diagrammatically provides a graph of the standardized output voltage $U_A$ as a percentage as a function of the grain weight. The target characteristic 42 of a single sheet in the case of logarithmic amplification is plotted over the gram weight range. In the upper area and in continuous line form is also plotted the air threshold LS and in the lower area in broken line form the double sheet threshold DBS.

It is important that the double sheet threshold can be dynamically provided and this can take place constantly over gram weight range sections. This is illustrated by lines B1, B2 and B3. The dynamic setting of the double sheet threshold can take place linearly or as a random degree polynomial line, as is e.g. shown between P1, P2, P3 and P4.

With this dynamic setting of the double sheet threshold it is possible to bring about a further extension of the measurable gram weight or weight per unit area ranges, so that a further increase in the detectable material spectrum can occur.

FIG. 11 relates to a substantially similar graph to FIG. 10, the path of the target characteristic 42 for the single sheet largely coinciding over the entire gram weight range. The dynamic threshold MBS for the multiple sheet and its path between points P1*a*, P2*a* and P3*a* is plotted. Curve 44 marks the upper value of the flutter range for single sheet and curve 45 the lower value of the flutter range for a single sheet.

FIG. 12*a*, 12*b* diagrammatically shows the arrangement for detection of single-corrugation corrugated board 51 and two-corrugation corrugated board 60, as well as the running direction L, whilst taking account of two, more particularly ultrasonic sensors 61, 62.

Corrugated board 51 according to FIG. 12*a* is in single-corrugation form and has at its adhesion points with a lower base layer 52 or upper top layer 53 adhesive areas 54 and webs linking the bottom and top layers spread over a corrugated surface 55. These webs 55 between the board corrugation and the corresponding, e.g. horizontally directed bottom or top layers, constitutes an "acoustic short-circuit" when using ultrasonics.

The sensor used in FIG. 12*a* has a transmitter T and receiver R, whose main axes are oriented coaxially to one another. The orientation of transmitter T and receiver R preferably takes place approximately perpendicular to the largest corrugation surface 55 or under an angle $\beta_1$ to the perpendicular of the single-corrugation corrugated board. Angle $\beta_2$ is the angle between the perpendicular to the corrugated board and the surface direction of the main surface of the corrugation.

The optimum angle $\beta_1$ in the case of an ultrasonic sensor for coupling noise onto a single-corrugation corrugated board, which has a necessary acoustic short-circuit AK between bottom layer 52 and top layer 53 is determined by the gradient t/2 h. t is the spacing between two corrugation peaks and h the height of the peak or the spacing between the bottom and top layers.

With an optimum sensor arrangement, the aim is to achieve an orientation with $\beta_1=\beta_2$ and in the example said angle would be 45°. However, the coincidence of angles $\beta_1$ and $\beta_2$ is not necessary for detecting missing, single or multiple corrugated board layers.

FIG. 12*b* shows a two-layer corrugated board 60 with the lower, first corrugation 58 and the upper, second corrugation 59. The arrangement of an ultrasonic sensor T, R corresponds to that of FIG. 12*a*.

Here again, the acoustic short-circuit AK1 and AK2 between the individual layers, i.e. a material connection in the sense of a web adhering to the layers for the connection of the individual top layers is essential for detection purposes with two or multiple-corrugation corrugated boards. It is possible in this way in the case of an ultrasonic sensor to transmit high sound energy to the multiple-corrugation corrugated board, so that there is a maximum force action approximately perpendicular to the spread out corrugation surface.

Whilst taking account of the preceding description, from the method and device standpoint the invention provides a solution for the reliable detection of single, missing and multiple, specifically double sheets, this not only applying over a very wide gram weight and weight per unit area range, but also with respect to flexible use possibilities and different material spectra.

The invention claimed is:

1. Method for the contactless detection of flat objects, such as papers in sheet form with respect to a single sheet, a missing sheet and multiple sheets of said flat objects, said flat objects being placed in a beam path of at least one transmitter (T) and an associated receiver (R) of a sensor device, wherein a radiation transmitted between said at least one transmitter (T) and said receiver (R) is received by said receiver (R) in the form of a measuring signal ($U_M$), said measuring signal ($U_M$) is supplied to a following evaluation for generating a corresponding detection signal, wherein a characteristic of an input voltage ($U_E$, $U_M$) of said measuring signal ($U_M$) is formed, wherein at least one correction characteristic (KK) is provided for evaluation, said correction characteristic (KK) transforms said characteristic of the input voltage ($U_E$, $U_M$) of said measuring signal ($U_M$) from said receiver (R) as a function of a weight per unit area of said flat objects to a target characteristic (ZK), wherein for said papers in sheet form an approximately linear characteristic approaching an ideal single sheet characteristic with a gradient of approximately "0" is obtained as said target characteristic between an output voltage ($U_A$, $U_Z$) at an output of the evaluation and said weight per unit area, in order to generate said corresponding detection signal, and wherein said sensor device is operated in a switchable manner, in pulsed operation, or continuous operation.

2. Method according to claim 1, wherein said correction characteristic (KK) for papers is derived from a characteristic of said input voltage ($U_E$, $U_M$) of said measuring signal mirrored on an ideal or approximated target characteristic (ZK) for single sheet detection.

3. Method according to claim 1, wherein the correction characteristic for papers is derived from a target characteristic approximated to the ideal target characteristic of the single sheet detection following Cartesian coordinate transformation with respect to a line linking two end points of the characteristic of said measuring signal for a material spectrum of said weight per unit area to be detected, mirroring the characteristic of the input voltage ($U_E$, $U_M$) of the measuring signal.

4. Method according to claim 1, wherein said characteristic of the input voltage ($U_E$, $U_M$) of the measuring signal is transformed using said correction characteristic into said target characteristic over a wide weight per unit area range between about 8 and 4000 g/m$^2$.

5. Method according to claim 1, wherein as flat objects also cardboard in sheet form, corrugated board or stackable packages are placed in the beam path between transmitter (T) and receiver (R).

6. Method according to claim 1, wherein said correction characteristic is impressed as a single characteristic over the entire weight per unit area range.

7. Method according to claim 1, wherein said correction characteristic is impressed as a zonal combination of several different correction characteristics.

8. Method according to claim 1, wherein said correction characteristic is impressed as a continuous correction characteristic over portions of the entire weight per unit area range.

9. Method according to claim 1, wherein said correction characteristic is fixed, and wherein said fixed correction characteristic is impressed.

10. Method according to claim 1, wherein said correction characteristic is actively controlled.

11. Method according to claim 1, wherein said correction characteristic is determined as a function of the object and material-specific transmission attenuation and the resulting measuring signal voltage depending on the weight per unit area, and wherein from this determination takes place of the optimum correction characteristic.

12. Method according to claim 1, wherein at least one sensor, selected from the group consisting of an ultrasonic sensor, an optical sensor, a capacitive sensor, and an inductive sensor, is used as said sensor device.

13. Method according to claim 1, wherein said transmitter (T) and receiver (R) of said sensor device are oriented with respect to one another in a main beam axis of the radiation used and wherein the main beam axis is oriented substantially perpendicular to plane of said flat objects moved at least relative between the transmitter (T) and the receiver (R).

14. Method according to claim 1, wherein said transmitter (T) and receiver (R) of said sensor device are oriented with respect to one another in a main beam axis of the radiation used and wherein the main beam axis is oriented under an angle to a plane of said flat objects moved at least relative between the transmitter (T) and the receiver (R).

15. Method according to claim 1, wherein in continuous operation of the sensor device short interruptions of the transmitting signal are provided to prevent standing waves and interferences.

16. Method according to claim 1, wherein the transmitting signal of said transmitter (T) is frequency-modulated.

17. Method according to claim 1, wherein for ultrasonics, transmitter (T) and receiver (R) are standardized pairwise to an optimum assembly spacing and wherein tolerances of the transmitter (T) and receiver (R) are automatically corrected at the start and during continuous operation.

18. Method according to claim 1, wherein a spacing between said transmitter (T) and receiver (R) is determined by reflection of the radiation used between transmitter (T) and receiver (R), and wherein on rising above or dropping below a permitted spacing a fault announcement is provided.

19. Method according to claim 1, wherein a feedback for maximizing an amplitude of said measuring signal received is performed between a device for performing said evaluating and said transmitter (T).

20. Method according to claim 1, wherein an amplitude of the measuring signal is evaluated, wherein the evaluation of the measuring signal amplitude is performed at least over one signal amplification, and wherein said signal amplification is supplied with at least one correction characteristic in such a way that at the signal amplification output said target characteristic for generating the detection signal is obtained.

21. Method according to claim 20, wherein analog signals of an analog-digital conversion received in the receiver (R) with subsequent or direct digital rating are subject to at least one correction characteristic for generating said corresponding detection signal.

22. Method according to claim 21, wherein for digitizing the analog measuring signal use is made of at least one A/D converter and for selecting the different signals of the signal amplifying devices use is made of a time multiplex method.

23. Method according to claim 1, wherein with respect to the single, missing or multiple sheet, at least two thresholds are given as an upper and lower threshold and in the case of the incoming measuring signal being larger than the upper threshold, it is evaluated as a "missing sheet", when the incoming measuring signal is between the thresholds this is evaluated as a "single sheet" and when the incoming measuring signal is smaller than the lower threshold, this is evaluated as a "multiple sheet".

24. Method according to claim 23, wherein the thresholds are dynamically carried along.

25. Method according to claim 1, wherein said correction characteristic for several areas of material spectra is subdivided into several sections.

26. Method according to claim 25, wherein at least three sections are provided and associated with different weight per unit area ranges.

27. Method for the contactless detection of flat objects, such as multilaminated materials like labels adhesively applied to support material, with respect to a presence or absence of said flat objects, said flat objects being placed in a beam path between a transmitter (T) and an associated receiver (R) of a sensor device, wherein a radiation transmitted through the flat objects or the radiation received in the case of an absence of said flat objects by said receiver (R), is received as a measuring signal ($U_M$), said measuring signal ($U_M$) is supplied to a following evaluation for generating a corresponding detection signal, wherein a characteristic of an input voltage ($U_E$, $U_M$) of said measuring signal ($U_M$) is formed, wherein at least one correction characteristic (KK) is supplied to said evaluation, said correction characteristic (KK) transforms the characteristic of the input voltage ($U_E$, $U_M$) of said measuring signal ($U_M$) from said receiver (R) as a function of a weight per unit area of said flat objects to a target characteristic (ZK), wherein for said multilaminated materials an almost linear characteristic with a maximum finite gradient in said weight per unit area range to be detected is obtained as said target characteristic approximated to an ideal target characteristic between an output voltage ($U_A$, $U_Z$) at the output of the evaluation and said weight per unit area, for generating said corresponding detection signal, and wherein said sensor device is operated in a switchable manner, in pulsed operation, or continuous operation.

28. Method according to claim 27, wherein said correction characteristic (KK) for multilaminated materials like labels is derived from the characteristic of said input voltage ($U_E$, $U_M$) of said measuring signal, which is mirrored on an ideal detection characteristic (ZK) for multilaminated materials in the weight per unit area range to be detected.

29. Method according to claim 27, wherein said correction characteristic (KK) for multilaminated materials like labels is derived from the characteristic of said input voltage ($U_E$, $U_M$) of said measuring signal, which is mirrored on an ideal detection characteristic (ZK) for multilaminated materials in weight per unit area range to be detected following Cartesian coordinate transformation relative to a connecting line of two end points of the measuring signal characteristic for a material spectrum of said weight per unit area range to be detected.

30. Method according to claim 27, wherein in the case of multilaminated materials like labels, the characteristic of said input voltage ($U_E$, $U_M$) of said measuring signal is transformed using said correction characteristic (KK) to said target characteristic (ZK) over the weight per unit area range to be detected, between approximately 40 to 300 g/m$^2$.

31. Method according to claim 27, wherein said correction characteristic (KK) is chosen in such a way that said target characteristic (ZK) is obtained with a maximum finite, constant negative gradient and maximum voltage difference over the weight per unit area range to be detected, between approximately 40 to 300 g/m$^2$.

32. Method according to claim 27, wherein an amplitude of the measuring signal is evaluated, wherein the evaluation of the measuring signal amplitude is performed at least over one signal amplification, and wherein said signal amplification is supplied with at least one correction characteristic in such a way that at the signal amplification output said target characteristic for generating the detection signal is obtained.

33. Method according to claim 27, wherein at least one sensor, selected from the group consisting of an ultrasonic sensor, an optical sensor, a capacitive sensor, and an inductive sensor, is used as said sensor device.

34. Method according to claim 27, wherein said transmitter (T) and receiver (R) of said sensor device are oriented with respect to one another in a main beam axis of the radiation used and wherein the main beam axis is oriented substantially perpendicular to a plane of said flat objects moved at least relative between the transmitter (T) and the receiver (R).

35. Method according to claim 27, wherein said transmitter (T) and receiver (R) of said sensor device are oriented with respect to one another in a main beam axis of the radiation used and wherein the main beam axis is oriented under an angle to a plane of said flat objects moved at least relative between the transmitter (T) and the receiver (R).

36. Method according to claim 27, wherein for the detection of single-corrugation or multiple-corrugation corrugated board and the conveying direction thereof, a sensor axis between the transmitter (T) and receiver (R) of at least one sensor is placed so as to be inclined to a perpendicular of the corrugated board sheet and orthogonally to a widest surface of the corrugated board corrugation.

37. Method according to claim 27, wherein relative to flat objects like labels, splices and break points and tear-off threads there is at least one detection threshold, on passing below said detection threshold this is evaluated as a "multiple layer" and on exceeding the detection threshold it is evaluated as a "support material or a multiple layer reduced by at least one layer".

38. Method according to claim 37, wherein said at least one detection threshold is dynamically carried along.

39. Device for the contactless detection of flat objects, with first flat objects such as papers in sheet form, with respect to a single sheet, a missing sheet and multiple sheets of said first flat objects, and second flat objects such as multilaminated materials like labels adhesively applied to support materials, with respect to a presence or absence of said second flat objects, said device having at least one sensor device with at least one transmitter (T) and an associated receiver (R), said first and second flat objects being placed in a beam path between said transmitter (T) and said receiver (R) for detection, said receiver (R) receiving a measuring signal by a radiation transmitted between said at least one transmitter (T) and said associated receiver (R), with means for forming a characteristic of an input voltage ($U_E$, $U_M$) of said measuring signal ($U_M$), and with a downstream evaluating device to which said measuring signal ($U_M$, $U_E$) is supplied for generating a corresponding detection signal, wherein said evaluating device has several specific channels for the detection of said first flat objects such as papers and said second flat objects such as multilaminated materials, said specific channels having impressed different correction characteristics for the characteristic of the input voltage ($U_E$, $U_M$) of said measuring signal ($U_M$) for papers and for multilaminated materials, said correction characteristics (KK) transform said characteristics of the input voltage ($U_E$, $U_M$) of said measuring signal from said receiver (R) as a function of a weight per unit area of the flat objects so as to give a corresponding target characteristic (ZK), wherein the first flat objects such as papers produce an approximately linear characteristic approaching an ideal single sheet characteristic with a gradient of approximately "0" in the form of said corresponding target characteristic (ZK) between an output voltage ($U_A$, $U_Z$) at an output of said evaluating device and the weight per unit area, in order to generate said corresponding detection signal, for said first flat objects, wherein the second flat objects such as multilaminated materials produce an almost linear characteristic having a maximum finite gradient in said weight per unit area range to be detected, as a target characteristic approximating said ideal target characteristic between an output voltage ($U_A$, $Z_U$) at the output of said evaluation device and said weight per unit area, in order to generate said corresponding detection signal for said second flat objects, wherein said sensor device has an operating mode which can be transformed from pulsed operation to continuous operation and vice versa, and wherein in continuous operation the transmitting signal has phase jumps or short interruptions.

40. Device according to claim 39, wherein the evaluating device has a correction characteristic (KK) for said first flat objects with a characteristic of said input voltage ($U_E$, $U_M$) of the measuring signal mirroring the ideal or thereto approximated target characteristic (ZK) for the purpose of single sheet detection.

41. Device according to claim 39, wherein said correction characteristic for first flat objects is chosen in such a way that the characteristic of said input voltage ($U_E$, $U_M$) of the measuring signal is transformable into the target characteristic over a weight per unit area range between about 8 and 4000 g/m$^2$.

42. Device according to claim 39, wherein said correction characteristic (KK) for the second flat objects can be produced by mirroring the characteristic of said input voltage ($U_E$, $U_M$) of the measuring signal on an ideal detection target characteristic (ZK) for the second flat objects in the weight per unit area range to be detected.

43. Device according to claim 39, wherein said correction characteristic for the second flat objects is chosen in such a way that the characteristic of the measuring signal input voltage ($U_E$, $U_M$) is transformable to the target characteristic over a weight per unit area range of approximately 40 to 300 g/m$^2$.

44. Device according to claim 39, wherein said target characteristic (ZK) for the second flat objects has a maximum, constant negative gradient and a maximum voltage difference relative to changes in the weight per unit area range between about 40 to 300 g/m$^2$.

45. Device according to claim 39, wherein said evaluating device has at least one amplifying device and wherein each amplifying device is supplied with at least one correction characteristic (KK) for producing said target characteristic (ZK) at the output of said amplifying device.

46. Device according to claim 39, wherein said evaluating device has an analog-digital converter means for converting said measuring signal from said receiver (R) and wherein an evaluating device for a subsequent digital evaluation of said converted measuring signal by means of a correction characteristic (KK) is provided for generating said detection signal.

47. Device according to claim 39, wherein said correction characteristic is built up as a zonal combination of several different correction characteristics over the entire weight per unit area range.

48. Device according to claim 39, wherein said correction characteristic for the first flat objects is provided as an almost inverse characteristic to said characteristic of the measuring signal input voltage ($U_E$, $U_M$).

49. Device according to claim 39, wherein said correction characteristic (KK) is fixed, and wherein said fixed correction characteristic is impressed.

50. Device according to claim 39, wherein said correction characteristic (KK) is given in a material specific manner.

51. Device according to claim 39, wherein said correction characteristic (KK) is regulated dynamically.

52. Device according to claim 39, wherein said second flat objects are passed between said transmitter (T) and receiver (R) and as a function of the specific object measuring signal received and wherein the object-specific switching threshold can be determined in automatic triggered manner relative to the target characteristic.

53. Device according to claim 39, wherein said transmitter (T) and receiver (R) of the sensor device are mutually oriented in a main beam axis of the radiation, and wherein the main beam axis is oriented substantially perpendicular to a plane of the flat objects arranged between the transmitter (T) and receiver (R).

54. Device according to claim 39, wherein said transmitter (T) and receiver (R) of the sensor device are mutually oriented in a main beam axis of the radiation, and wherein the main beam axis is oriented under an angle to a plane of the flat objects arranged between transmitter (T) and receiver (R).

55. Device according to claim 39, wherein said evaluating device has several, parallel-connected amplifying devices, whose output signals are combined for said target characteristic.

56. Device according to claim 39, wherein said transmitting signal is frequency-modulated.

57. Device according to claim 39, wherein a device for setting a transmitting frequency and/or transmitting amplitude with respect to the receiver (R) signal is provided.

58. Device according to claim 39, wherein auto-balancing means are provided and auto-balancing can be performed in times synchronized with a transmitting frequency or in defined pause periods.

59. Device according to claim 39, wherein said transmitter (T) and receiver (R) have sensor heads and wherein a spacing between said sensor heads can be varied.

60. Device according to claim 39, wherein there is a feedback device between said evaluating device and said sensor device.

61. Device according to claim 39, wherein said evaluating device has several specific channels for the detection of said first flat objects and said second flat objects, wherein different correction characteristics are impressed on the channels, and wherein there are multiplexers for controlling the inputs and outputs of said channels for producing an overall target characteristic.

62. Device according to claim 39, wherein said transmitter (T) is provided below the flat objects to be detected and said receiver (R) above the flat objects to be detected, and wherein a head of the transmitter (T) has a limited spacing from the flat object.

63. Device according to claim 39, wherein with respect to the single, missing and multiple sheet for the first flat objects, said evaluating device is provided with at least two thresholds in the form of an upper and lower threshold and when the incoming measuring signal is greater than the upper threshold, this is detected as a "missing sheet", when the incoming measuring signal is between the thresholds this is detected as a "single sheet" and when the incoming measuring signal is smaller than the lower threshold, this is detected as a "multiple sheet".

64. Device according to claim 63, wherein the thresholds are set in a fixed manner.

65. Device according to claim 63, wherein the thresholds are dynamically carried along.

66. Device according to claim 39, wherein the sensor device has at least one sensor selected from the group consisting of ultrasonic sensors, optical sensors, capacitive sensors, and inductive sensors.

67. Device according to claim 66, wherein between the transmitter (T) and said flat objects to be detected there is at least one lens for improving a spatial resolution of ultrasonic and optical sensors.

68. Device according to claim 66, wherein between the transmitter (T) and said flat objects to be detected there is at least one pinhole diaphragm for improving a spatial resolution of ultrasonic and optical sensors.

69. Device according to claim 68, wherein each diaphragm is arranged transversely to a movement direction of said flat objects.

70. Device according to claim 68, wherein each diaphragm is arranged longitudinally to a movement direction of the second flat objects.

71. Device according to claim 68, wherein slit diaphragms are positioned in a thread running direction for detecting elongated second flat objects adhesively applied to the support material.

72. Device according to claim 68, wherein said flat objects introduced between transmitter (T), receiver (R) and the diaphragm float as close as possible over the diaphragm.

* * * * *